US009470989B2

(12) United States Patent
Tomono et al.

(10) Patent No.: US 9,470,989 B2
(45) Date of Patent: Oct. 18, 2016

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Hiroyuki Tomono, Numazu (JP); Haruyuki Tsuji, Yokohama (JP); Atsushi Fujii, Yokohama (JP); Kazuhisa Shida, Kawasaki (JP); Nobuhiro Nakamura, Numazu (JP); Hideaki Matsuoka, Mishima (JP); Takashi Anezaki, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/629,251

(22) Filed: Feb. 23, 2015

(65) Prior Publication Data

US 2015/0241800 A1 Aug. 27, 2015

(30) Foreign Application Priority Data

Feb. 24, 2014 (JP) ..... 2014-033338

(51) Int. Cl.
*G03G 5/14* (2006.01)
*G03G 5/10* (2006.01)

(52) U.S. Cl.
CPC ..... *G03G 5/144* (2013.01); *G03G 5/104* (2013.01)

(58) Field of Classification Search
CPC ..... G03G 5/144
USPC ..... 430/63
See application file for complete search history.

(56) References Cited

U.S. PATENT DOCUMENTS

| | | | | |
|---|---|---|---|---|
| 2002/0048711 | A1* | 4/2002 | Ito | G03G 5/144 430/63 |
| 2012/0114375 | A1* | 5/2012 | Fujii | G03G 5/144 399/111 |
| 2014/0065529 | A1* | 3/2014 | Fujii | G03G 5/144 430/63 |
| 2015/0205218 | A1* | 7/2015 | Tsuji | G03G 5/144 430/56 |

FOREIGN PATENT DOCUMENTS

| | | | |
|---|---|---|---|
| JP | H02197014 | A | 8/1990 |
| JP | H04191861 | A | 7/1992 |
| JP | H07295245 | A | 11/1995 |
| JP | H09278445 | A | 10/1997 |

(Continued)

*Primary Examiner* — Christopher Rodee
(74) *Attorney, Agent, or Firm* — Canon U.S.A., Inc., IP Division

(57) ABSTRACT

A conductive layer of an electrophotographic photosensitive member contains a first metal oxide particle, a second metal oxide particle, and a binder material. The first metal oxide particle is a zinc oxide particle or tin oxide particle coated with tin oxide doped with phosphorus, tungsten, fluorine, niobium, or tantalum, and the second metal oxide particle is a tin oxide particle doped with an element selected from the group consisting of phosphorus, tungsten, fluorine, niobium, and tantalum, the element being the same as the element with which the tin oxide of the first metal oxide particle is doped. The conductive layer satisfies formulae (1) and (2)

$$2 \leq \{(V_2/V_T)/(V_1/V_T)\} \times 100 \leq 25 \quad \text{formulae (1):}$$

$$15 \leq \{(V_1/V_T)+(V_2/V_T)\} \times 100 \leq 45 \quad \text{formulae (2).}$$

12 Claims, 4 Drawing Sheets

(56) References Cited

FOREIGN PATENT DOCUMENTS

| | | | |
|---|---|---|---|
| JP | H01053417 | A | 2/1998 |
| JP | 3365821 | B2 | 1/2003 |
| JP | 2004151349 | A | 5/2004 |
| JP | 2004349167 | A | 12/2004 |
| JP | 2007187771 | A | 7/2007 |
| JP | 2009058789 | A | 3/2009 |
| JP | 2010030886 | A | 2/2010 |
| JP | 2012018370 | A | 1/2012 |
| JP | 2013037289 | A | 2/2013 |
| JP | 2014029458 | A | 2/2014 |

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus each including an electrophotographic photosensitive member.

2. Description of the Related Art

In recent years, electrophotographic photosensitive members that use an organic photoconductive material (charge generation material) have been used as electrophotographic photosensitive members included in process cartridges and electrophotographic apparatuses. Electrophotographic photosensitive members generally include a support and a photosensitive layer formed on the support.

Furthermore, a conductive layer containing conductive particles (metal oxide particles) is disposed between the support and the photosensitive layer for the purpose of covering surface defects of the support and protecting the photosensitive layer from electrical breakdown. However, the potential of the conductive layer containing metal oxide particles easily varies due to environmental changes in temperature and humidity. There is a technique of improving the potential characteristics by improving metal oxide particles. Japanese Unexamined Patent Application Publication No. 2004-151349 describes a technique of using tantalum-doped tin oxide particles in a conductive layer. Japanese Unexamined Patent Application Publication No. 2007-187771 describes a technique of incorporating two types of metal oxide particles having different average particle sizes in an undercoat layer (conductive layer). Japanese Unexamined Patent Application Publication No. 4-191861 describes a technique of incorporating a zinc oxide powder and a tin oxide powder in an undercoat layer.

In recent years, the opportunity to output a large number of identical images within a short time has increased with the realization of high-speed electrophotographic apparatuses. However, in this case, an image defect called a pattern memory is easily caused.

The term "pattern memory" refers to a phenomenon in which, when a solid black image or a halftone image is output after a large number of images including vertical lines 306 (lines extending in a direction in which a recording medium moves), such as an image 301 illustrated in FIG. 4, are continuously output, memories are generated in portions where the vertical lines were formed. Specifically, when a solid black image 302 is output after a large number of images 301 including vertical lines 306 in FIG. 4 are continuously output, an image output as a solid black image is an image 304 including vertical lines 307 formed by the hysteresis of the vertical lines 306 in FIG. 4. Furthermore, when a halftone image 303 is output after a large number of images 301 in FIG. 4 are continuously output, an image output as a halftone image is an image 305 including vertical lines 308 formed by the hysteresis of the vertical lines 306 in FIG. 4 as in the case of the solid black image.

As a result of studies conducted by the present inventors, it has been found that such a pattern memory is sometimes caused in the electrophotographic photosensitive members including a conductive layer and described in the above documents, and thus there is a room for further improvement.

In the conductive layer containing metal oxide particles, an increase in residual potential and the formation of cracks in a conductive layer are in a trade-off relationship. Therefore, the suppression of an increase in residual potential and formation of cracks is required in addition to the suppression of formation of the pattern memory.

The present invention provides an electrophotographic photosensitive member in which an increase in residual potential, formation of a pattern memory, and formation of cracks in a conductive layer are suppressed, and a process cartridge and an electrophotographic apparatus including the electrophotographic photosensitive member.

SUMMARY OF THE INVENTION

An electrophotographic photosensitive member according to one aspect of the present invention includes:

a support;

a conductive layer on the support; and a photosensitive layer on the conductive layer, wherein the conductive layer contains:

a binder material;

a first metal oxide particle; and a second metal oxide particle, the first metal oxide particle is a zinc oxide particle coated with tin oxide doped with either one element of phosphorus, tungsten, niobium, tantalum, and fluorine or a tin oxide particle coated with tin oxide doped with either one element of phosphorus, tungsten, niobium, tantalum, and fluorine, the second metal oxide particle is a tin oxide particle doped with either one element of phosphorus, tungsten, niobium, tantalum, and fluorine, the element with which the tin oxide particle is doped being the same as the element with which the tin oxide of the first metal oxide particle is doped, and the conductive layer satisfies the following formulae (1) and (2), $$2 \leq \{(V_2/V_T)/(V_1/V_T)\} \times 100 \leq 25 \quad (1)$$

$$15 \leq \{(V_1/V_T)+(V_2/V_T)\} \times 100 \leq 45 \quad (2)$$

where in the formulae (1) and (2), $V_T$ represents a total volume of the conductive layer, $V_1$ represents a total volume of the first metal oxide particle in the conductive layer, and $V_2$ represents a total volume of the second metal oxide particle in the conductive layer.

A process cartridge according to another aspect of the present invention is detachably attachable to a main body of an electrophotographic apparatus, wherein the process cartridge integrally supports the electrophotographic photosensitive member and at least one selected from the group consisting of a charging device, a developing device, and a cleaning member.

An electrophotographic apparatus according to another aspect of the present invention includes the electrophotographic photosensitive member, a charging device, an exposing device, a developing device, and a transfer device.

According to the present invention, there can be provided an electrophotographic photosensitive member in which an increase in residual potential, formation of a pattern memory, and formation of cracks in a conductive layer are suppressed.

Further features of the present invention will become apparent from the following description of exemplary embodiments with reference to the attached drawings.

DESCRIPTION OF THE EMBODIMENTS

The electrophotographic photosensitive member according to an embodiment of the present invention is an electrophotographic photosensitive member including at least a support, a conductive layer formed on the support, and a photosensitive layer formed on the conductive layer.

The photosensitive layer is classified into a single-layer type photosensitive layer in which a charge generation material and a charge transport material are contained in a single layer and a multilayer type photosensitive layer in which a charge generating layer containing a charge generation material and a charge transporting layer containing a charge transport material are stacked. In an embodiment of the present invention, a multilayer type photosensitive layer can be used. If necessary, an undercoat layer may be disposed between the conductive layer and the photosensitive layer.

Figure 6A:
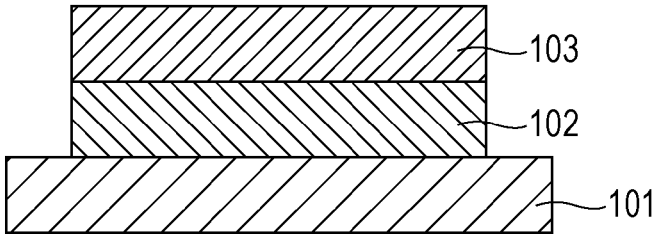
FIGS. 6A and 6B are diagrams for describing examples of layer structures of an electrophotographic photosensitive member.
Figure 6B:
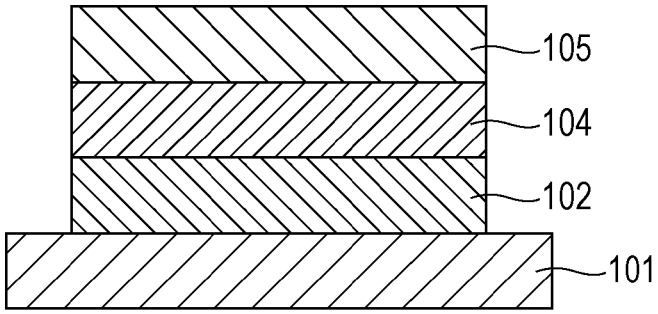

FIGS. 6A and 6B illustrate examples of layer structures of the electrophotographic photosensitive member according to an embodiment of the present invention. In FIG. 6A, a conductive layer 102 and a photosensitive layer 103 are disposed on a support 101 in that order. In FIG. 6B, a conductive layer 102, a charge generating layer 104, and a charge transporting layer 105 are disposed on a support 101 in that order.

Support

A support having conductivity (conductive support) can be used. For example, a metal support formed of a metal or an alloy such as aluminum, an aluminum alloy, or stainless steel can be used. When aluminum or an aluminum alloy is used, an aluminum tube produced by a method including extrusion and drawing or an aluminum tube produced by a method including extrusion and ironing can be used.

Conductive Layer

The conductive layer contains first metal oxide particles, second metal oxide particles, and a binder material.

The first metal oxide particles are zinc oxide particles coated with tin oxide doped with phosphorus, tungsten, fluorine, niobium, or tantalum or tin oxide particles coated with tin oxide doped with phosphorus, tungsten, fluorine, niobium, or tantalum.

Specifically, the first metal oxide particles are zinc oxide particles coated with tin oxide doped with phosphorus, tin oxide particles coated with tin oxide doped with phosphorus, zinc oxide particles coated with tin oxide doped with tungsten, tin oxide particles coated with tin oxide doped with tungsten, zinc oxide particles coated with tin oxide doped with fluorine, tin oxide particles coated with tin oxide doped with fluorine, zinc oxide particles coated with tin oxide doped with niobium, tin oxide particles coated with tin oxide doped with niobium, zinc oxide particles coated with tin oxide doped with tantalum, or tin oxide particles coated with tin oxide doped with tantalum.

The second metal oxide particles are tin oxide particles doped with either one element of phosphorus, tungsten, fluorine, niobium, and tantalum. The element with which the tin oxide particles are doped is the same as the element with which the tin oxide of the first metal oxide particles is doped. Specifically, the second metal oxide particles are tin oxide particles doped with phosphorus, tin oxide particles doped with tungsten, tin oxide particles doped with fluorine, tin oxide particles doped with niobium, or tin oxide particles doped with tantalum.

Herein, the zinc oxide particles are particles of zinc oxide (ZnO), and the tin oxide particles are particles of tin oxide ($SnO_2$).

Hereafter, the zinc oxide particles coated with tin oxide doped with phosphorus are also referred to as "P-doped tin oxide-coated zinc oxide particles". The tin oxide particles coated with tin oxide doped with phosphorus are also referred to as "P-doped tin oxide-coated tin oxide particles". The tin oxide particles doped with phosphorus are also referred to as "P-doped tin oxide particles".

The zinc oxide particles coated with tin oxide doped with tungsten are also referred to as "W-doped tin oxide-coated zinc oxide particles". The tin oxide particles coated with tin oxide doped with tungsten are also referred to as "W-doped tin oxide-coated tin oxide particles". The tin oxide particles doped with tungsten are also referred to as "W-doped tin oxide particles".

The zinc oxide particles coated with tin oxide doped with fluorine are also referred to as "F-doped tin oxide-coated zinc oxide particles". The tin oxide particles coated with tin oxide doped with fluorine are also referred to as "F-doped tin oxide-coated tin oxide particles". The tin oxide particles doped with fluorine are also referred to as "F-doped tin oxide particles".

The zinc oxide particles coated with tin oxide doped with niobium are also referred to as "Nb-doped tin oxide-coated zinc oxide particles". The tin oxide particles coated with tin oxide doped with niobium are also referred to as "Nb-doped tin oxide-coated tin oxide particles". The tin oxide particles doped with niobium are also referred to as "Nb-doped tin oxide particles".

The zinc oxide particles coated with tin oxide doped with tantalum are also referred to as "Ta-doped tin oxide-coated zinc oxide particles". The tin oxide particles coated with tin oxide doped with tantalum are also referred to as "Ta-doped tin oxide-coated tin oxide particles". The tin oxide particles doped with tantalum are also referred to as "Ta-doped tin oxide particles".

Furthermore, the conductive layer satisfies formulae (1) and (2) below.

$$2 \leq \{(V_2/V_T)/(V_1/V_T)\} \times 100 \leq 25 \quad (1)$$

$$15 \leq \{(V_1/V_T)+(V_2/V_T)\} \times 100 \leq 45 \quad (2)$$

In the formulae (1) and (2), $V_T$ represents the total volume of the conductive layer, $V_1$ represents a volume ($cm^3$) of the first metal oxide particles in the conductive layer, and $V_2$ represents a volume ($cm^3$) of the second metal oxide particles in the conductive layer.

As a result of diligent studies, the present inventors have found that the pattern memory is suppressed when a good conductive path is widely formed in the conductive layer, that is, when charges uniformly move in the conductive layer. This is assumed to be because the local retention or storage of charges does not easily occur in the conductive layer. It is assumed that when the conductive layer contains the first metal oxide particles and the second metal oxide particles, a good conductive path is formed and the formation of a pattern memory is suppressed. When the conductive layer contains the first metal oxide particles and the second metal oxide particles at a particular ratio, a conductive path that passes through both the first metal oxide particles and the second metal oxide particles can be formed. This is achieved by satisfying the formula (1). If $\{(V_2/V_T)/(V_1/V_T)\}\times100$ is less than 2, the volume of the second metal oxide particles is much smaller than that of the first metal oxide particles. Consequently, a large amount of the first metal oxide particles is present in the conductive layer, and thus a good conductive path is not formed and the formation of a pattern memory is not sufficiently suppressed. On the other hand, if $\{(V_2/V_T)/(V_1/V_T)\}\times100$ is more than 25, the volume of the second metal oxide particles is much larger than that of the first metal oxide particles. Consequently, a large amount of the second metal oxide particles is present in the conductive layer, and thus a good conductive path is not formed and the formation of a pattern memory is not sufficiently suppressed.

Furthermore, it is assumed that when the sum of the content of the first metal oxide particles and the content of the second metal oxide particles in the conductive layer is within a particular range, a good conductive path that passes through both the first metal oxide particles and the second metal oxide particles can be formed. This is achieved by satisfying the formula (2). If $\{(V_1/V_T)+(V_2/V_T)\}\times100$ is less than 15, the total volume of the first metal oxide particles and the second metal oxide particles in the conductive layer decreases. Consequently, the retention of charges easily occurs and the residual potential easily increases. On the other hand, if $\{(V_1/V_T)+(V_2/V_T)\}\times100$ is more than 45, the volume of the binder material relatively decreases, and thus cracks are easily formed in the conductive layer.

By satisfying the formulae (1) and (2), an increase in residual potential, the formation of a pattern memory, and the formation of cracks in the conductive layer can be suppressed.

The conductive layer according to an embodiment of the present invention satisfies formula (4) below.

$$5\leq\{(V_2/V_T)/(V_1/V_T)\}\times100\leq20 \quad (4)$$

At a ratio between the first metal oxide particles and the second metal oxide particles obtained when the formula (4) is satisfied, a better conductive path can be formed, and thus the formation of a pattern memory is more effectively suppressed.

The conductive layer satisfies formula (5) below.

$$20\leq\{(V_1/V_T)+(V_2/V_T)\}\times100\leq40 \quad (5)$$

When the formula (5) is satisfied, the total volume of the first metal oxide particles and the second metal oxide particles in the conductive layer is appropriately controlled, and thus an increase in residual potential and the formation of cracks are favorably suppressed.

If the element with which the tin oxide of the first metal oxide particles is doped is different from the element with which the tin oxide of the second metal oxide particles is doped, an effect of suppressing the formation of a pattern memory easily decreases. It is assumed that if the tin oxides are doped with different elements, the physical properties such as electrical properties and surface properties of the first metal oxide particles and the second metal oxide particles are differentiated, and thus charges do not easily move in the conductive layer.

The conductive layer satisfies formula (3) below.

$$0.9\leq R_2/R_1\leq1.1 \quad (3)$$

$R_1$ (atom %) represents the ratio of phosphorus, tungsten, fluorine, niobium, or tantalum to the tin oxide that coats the first metal oxide particles; and $R_2$ (atom %) represents the ratio of phosphorus, tungsten, fluorine, niobium, or tantalum to the tin oxide in the second metal oxide particles.

When the formula (3) is satisfied, the ratio of phosphorus, tungsten, fluorine, niobium, or tantalum in the first metal oxide particles is close to the ratio of phosphorus, tungsten, fluorine, niobium, or tantalum in the second metal oxide particles. Consequently, a better conductive path is formed and the formation of a pattern memory is more effectively suppressed.

$R_1$ and $R_2$ can be measured by extracting the conductive layer of the electrophotographic photosensitive member by an FIB method and conducting STEM-EDX. $V_1$ and $V_2$ can be measured by extracting the conductive layer of the electrophotographic photosensitive member by an FIB method and conducting Slice & View of FIB-SEM.

First, the measurement of $R_1$ and $R_2$ will be described. The sample processing for the STEM-EDX analysis is performed as follows. The sample processing is performed by an FIB-μ sampling method using a copper (Cu) support. The instrument is FB-2000A μ-Sampling System (trade name) manufactured by Hitachi High-Technologies Corporation. The length and width of a sample are set within a measurable range, and the sampling is performed so that the thickness of the sample is 150 nm.

The STEM-EDX analysis is performed as follows. The analysis is performed using a field emission electron microscope (HRTEM) (trade name: JEM-2100F) manufactured by JEOL Ltd. and JED-2300T (trade name) (resolution: 133 eV or less) (energy dispersive X-ray spectroscopy) manufactured by JEOL Ltd. as an EDX unit.

The analysis conditions are described below.

System: Analysis Station

Image acquisition: Digital Micrograph

Measurement conditions: acceleration voltage 200 kV, beam size (diameter): 1.0 nm, measurement time: 50 seconds (point analysis) and 40 minutes (area analysis)

Measurement range: 3.6 μm in width×3.4 μm in length×150 nm in thickness

Since the element can be identified by STEM-EDX, $R_1$ (atom %) and $R_2$ (atom %) can be determined from the atomic ratio. The sampling is performed ten times in the same manner, and ten samples are measured. The averages of the ten values in total are defined as $R_1$ and $R_2$.

The first metal oxide particles are composite particles each including a coating layer composed of tin oxide doped with phosphorus, tungsten, fluorine, niobium, or tantalum and a core particle composed of zinc oxide or tin oxide.

The ratio (coating ratio) of tin oxide ($SnO_2$) that coats the first metal oxide particles can be 10 to 60 mass % based on the total mass of the first metal oxide particles. To control the coating ratio of the tin oxide, a tin raw material required to generate tin oxide can be added in the production of the first metal oxide particles. When, for example, tin chloride ($SnCl_4$) serving as a tin raw material is used, the amount of tin chloride added is determined in consideration of the coating ratio of tin oxide generated from the tin chloride. In an embodiment of the present invention, the coating ratio of the tin oxide of the first metal oxide particles is determined without taking into account the mass of phosphorus, tungsten, fluorine, niobium, or tantalum with which the tin oxide is doped.

The amount (doping ratio) of phosphorus, tungsten, fluorine, niobium, or tantalum with which the tin oxide in the first metal oxide particles or the second metal oxide particles is doped can be 0.1 to 10 mass % based on the tin oxide. In this case, the mass of the tin oxide is a mass of tin oxide not containing phosphorus, tungsten, fluorine, niobium, or tantalum.

A method for coating surfaces of the metal oxide particles with tin oxide doped with phosphorus, tungsten, fluorine, niobium, or tantalum is disclosed in Japanese Unexamined Patent Application Publication No. 2004-349167. A method for producing the tin oxide particles coated with tin oxide is disclosed in Japanese Unexamined Patent Application Publication No. 2010-30886.

A method for producing the second metal oxide particles is disclosed in Japanese Patent No. 3365821, Japanese Unexamined Patent Application Publication No. 02-197014, Japanese Unexamined Patent Application Publication No. 9-278445, or Japanese Unexamined Patent Application Publication No. 10-53417.

The shape of zinc oxide particles or tin oxide particles serving as core particles in the first metal oxide particles may be a particulate shape, a spherical shape, a needle-like shape, a fibrous shape, a columnar shape, a rod-like shape, a spindle shape, or a plate-like shape. Among them, a spherical shape is particularly employed because image defects such as black spots are not easily caused.

The core particles of the first metal oxide particles are zinc oxide particles or tin oxide particles. By using the above-described core particles, the dispersibility of the second metal oxide particles in a conductive layer-forming coating solution is improved, and thus the formation of a pattern memory is effectively suppressed.

The particle size of the zinc oxide particles or the tin oxide particles serving as the core particles of the first metal oxide particles can be 0.05 μm or more and 0.40 μm or less in order to adjust the average particle size of the first metal oxide particles in a desired range described below.

The powder resistivity of the first metal oxide particles is preferably $1.0\times10^{1}$ Ω·cm or more and $1.0\times10^{6}$ Ω·cm or less and more preferably $1.0\times10^{2}$ Ω·cm or more and $1.0\times10^{5}$ Ω·cm or less.

The powder resistivity of the second metal oxide particles is preferably $1.0\times10^{0}$ Ω·cm or more and $1.0\times10^{5}$ Ω·cm or less and more preferably $1.0\times10^{1}$ Ω·cm or more and $1.0\times10^{4}$ Ω·cm or less.

The powder resistivity of the first metal oxide particles can be lower than the powder resistivity of zinc oxide particles or tin oxide particles serving as the core particles of the first metal oxide particles.

A method for measuring the powder resistivity of metal oxide particles in the first metal oxide particles and the second metal oxide particles is described below.

The powder resistivity of the first metal oxide particles, the second metal oxide particles, and the core particles of the first metal oxide particles is measured in an ordinary-temperature and ordinary-humidity environment (23° C./50% RH). The measurement instrument is a resistivity meter (trade name: Loresta GP (Hiresta UP in the case of more than $1.0\times10^{7}$ Ω·cm)) manufactured by Mitsubishi Chemical Corporation. The metal oxide particles to be measured are formed into a pellet-shaped measurement sample by being solidified at a pressure of 500 kg/cm$^2$. The application voltage is 100 V. The powder resistivity of the core particles such as zinc oxide particles or tin oxide particles is measured before the coating layer composed of tin oxide is formed.

The conductive layer can be formed by applying a conductive layer-forming coating solution containing a solvent, a binder material, the first metal oxide particles, and the second metal oxide particles onto a support to form a coating film and then drying and/or curing the coating film.

The conductive layer-forming coating solution can be prepared by dispersing the first metal oxide particles, the second metal oxide particles, and a binder material in a solvent. The dispersion may be performed with a paint shaker, a sand mill, a ball mill, or a liquid collision high speed disperser.

Examples of the binder material used in the conductive layer include phenolic resin, polyurethane, polyamide, polyimide, polyamide-imide, polyvinyl acetal, epoxy resin, acrylic resin, melamine resin, and polyester. These binder materials may be used alone or in combination of two or more. Among these resins, a curable resin is preferably used and a heat-curable resin is more preferably used to suppress the migration (penetration) into other layers and increase the adhesiveness to the support. Among the heat-curable resins, a heat-curable phenolic resin or a heat-curable polyurethane is particularly used. When the curable resin is used as a binder material for the conductive layer, the binder material contained in the conductive layer-forming coating solution is a monomer and/or an oligomer of the curable resin.

Examples of the solvent used in the conductive layer-forming coating solution include alcohols such as methanol, ethanol, and isopropanol; ketones such as acetone, methyl ethyl ketone, and cyclohexanone; ethers such as tetrahydrofuran, dioxane, ethylene glycol monomethyl ether, and propylene glycol monomethyl ether; esters such as methyl acetate and ethyl acetate; and aromatic hydrocarbons such as toluene and xylene.

The conductive layer may contain a surface roughening material to suppress the generation of interference fringes on an output image due to the interference of light reflected at the surface of the conductive layer. The surface roughening material can be resin particles having a volume-average particle size of 1 μm or more and 5 μm or less. Examples of the resin particles include particles of curable resins such as curable rubber, polyurethane, epoxy resin, alkyd resin, phenolic resin, polyester, silicone resin, and acrylic-melamine resin. Among them, particles of silicone resin are particularly used because they are not easily aggregated. The density (0.5 to 2 g/cm$^3$) of the resin particles is lower than the densities (4 to 8 g/cm$^3$) of the first metal oxide particles and the second metal oxide particles. Therefore, the surface of the conductive layer can be efficiently roughened when the conductive layer is formed. To sufficiently produce the effects of the present invention, the content of the surface roughening material can be 1 to 80 mass % based on the binder material in the conductive layer.

The densities (g/cm$^3$) of the first metal oxide particles, the second metal oxide particles, the binder material (if the binder material is liquid, the binder material is cured and then the density is measured), and the silicone particles are determined as follows using a dry-process automatic densitometer (trade name: Accupyc 1330) manufactured by SHIMADZU CORPORATION. The densities are measured at 23° C. with a container having a volume of 10 cm$^3$. The pretreatment of an object to be measured is helium gas purge performed ten times at a maximum pressure of 19.5 psig. Subsequently, whether the pressure in the container reaches equilibrium is determined. When the fluctuation of the pressure in the chamber is 0.0050 psig/min or less, an equilibrium state is considered to be achieved and the density (g/cm$^3$) is automatically measured.

The conductive layer may also contain a leveling agent for improving the surface properties of the conductive layer. The conductive layer may also contain pigment particles to further improve the shielding property of the conductive layer.

The volume-average particle size of the first metal oxide particles is preferably 0.10 μm or more and 0.45 μm or less and more preferably 0.15 μm or more and 0.40 μm or less. In the above range, the local injection of charges into the photosensitive layer is suppressed, and thus the generation of black spots is suppressed.

The volume-average particle size of the second metal oxide particles is preferably 0.01 μm or more and 0.45 μm or less and more preferably 0.01 μm or more and 0.10 μm or less.

The volume-average particle sizes of the first metal oxide particles and the second metal oxide particles can be determined by the following liquid sedimentation method or cross-sectional observation with a scanning electron microscope (SEM).

The liquid sedimentation method is performed as follows. First, the conductive layer-forming coating solution is diluted with a solvent used to prepare the conductive layer-forming coating solution so that the transmittance is in the range of 0.8 to 1.0. Subsequently, a histogram showing the volume-average particle size and the particle size distribution of the metal oxide particles is made using an ultracentrifuge automatic particle size analyzer. In an embodiment of the present invention, an ultracentrifuge automatic particle size analyzer (trade name: CAPA700) manufactured by HORIBA, Ltd. is used and the measurement is performed at a rotational speed of 3000 rpm.

The cross-sectional observation with a SEM can be performed by a three-dimensional structure analysis obtained from the elemental mapping that uses FIB-SEM and the Slice & View of FIB-SEM.

The thickness of the conductive layer is preferably 10 μm or more and 40 μm or less and more preferably 15 μm or more and 35 μm or less to cover the surface defects of the support.

The thickness of each layer of the electrophotographic photosensitive member including the conductive layer is measured with FISHERSCOPE MMS manufactured by Fischer Instruments K.K.

The volume resistivity of the conductive layer is preferably $1.0\times10^8$ Ω·cm or more and $2.0\times10^{13}$ Ω·cm or less. In this range, charges satisfactorily flow through the conductive layer, and the residual potential and fogging are not easily generated. The volume resistivity is more preferably $1.0\times10^8$ Ω·cm or more and $5.0\times10^{12}$ Ω·cm or less.

Figure 2:
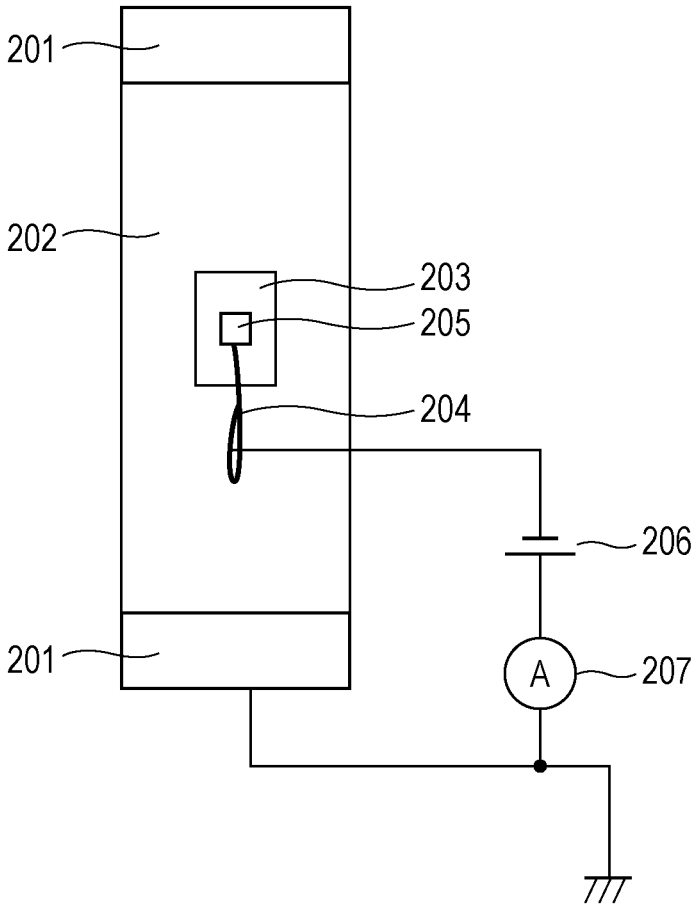
FIG. 2 is a top view for describing a method for measuring the volume resistivity of a conductive layer.
Figure 3:
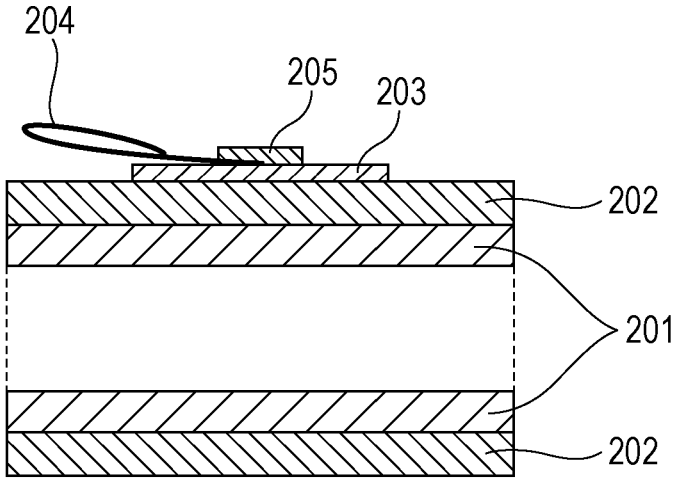
FIG. 3 is a sectional view for describing a method for measuring the volume resistivity of a conductive layer.
Figure 4:
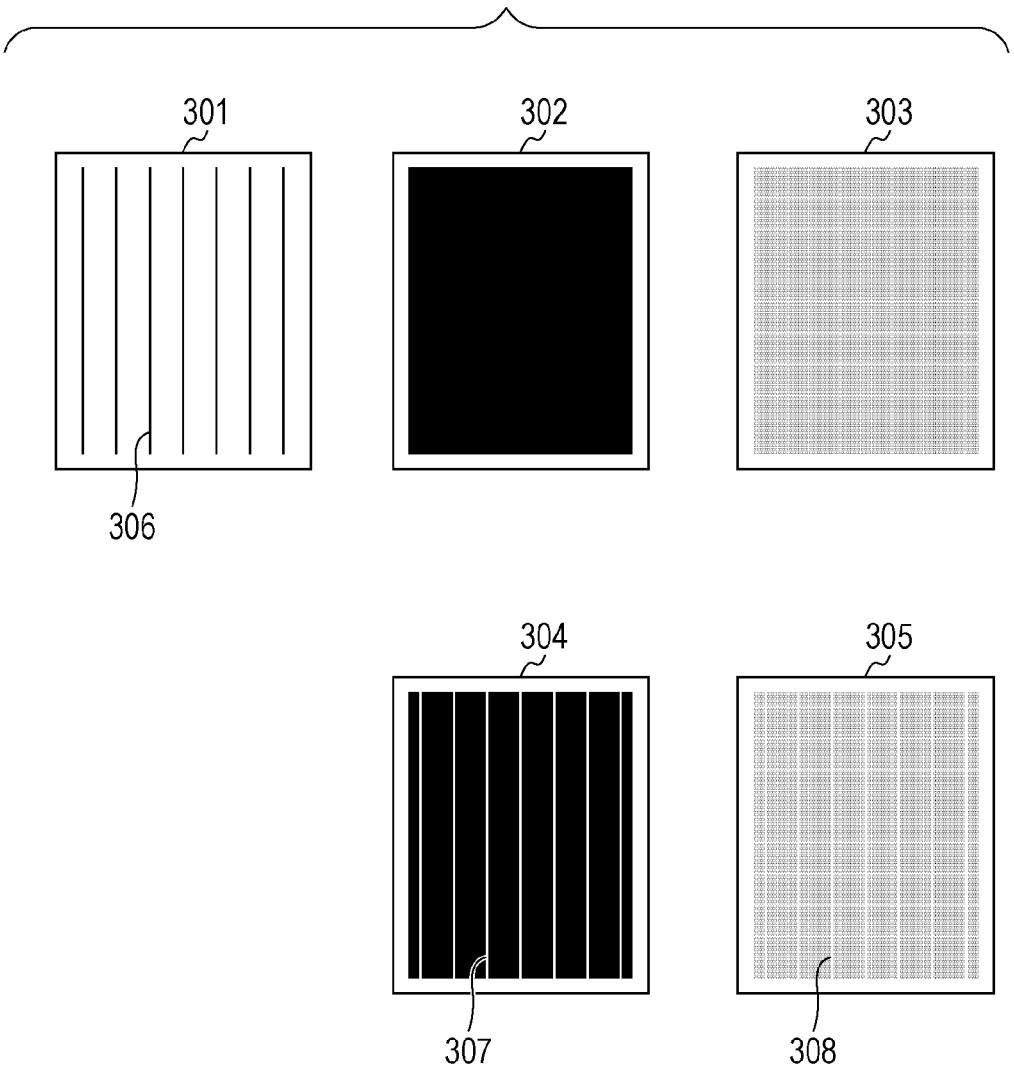
FIG. 4 illustrates image examples for describing a pattern memory.

A method for measuring the volume resistivity of the conductive layer of the electrophotographic photosensitive member will be described with reference to FIGS. 2 and 3. FIG. 2 is a top view for describing the method for measuring the volume resistivity of the conductive layer. FIG. 3 is a sectional view for describing the method for measuring the volume resistivity of the conductive layer.

The volume resistivity of the conductive layer is measured in an ordinary-temperature and ordinary-humidity environment (23° C./50% RH). A copper tape 203 (Model No. 1181 manufactured by Sumitomo 3M Limited) is attached to the surface of a conductive layer 202, and the copper tape 203 is treated as a front side electrode of the conductive layer 202. A support 201 is treated as a back side electrode of the conductive layer 202. A power supply 206 for applying a voltage between the copper tape 203 and the support 201 and an ammeter 207 for measuring an electric current that flows between the copper tape 203 and the support 201 are provided. A copper wire 204 is placed on the copper tape 203 to apply a voltage to the copper tape 203. A copper tape 205, which is the same as the copper tape 203, is attached onto the copper wire 204 so that the copper wire 204 does not lie outside the copper tape 203. Thus, the copper wire 204 is fixed. A voltage is applied to the copper tape 203 through the copper wire 204.

A value obtained from formula (4) below is defined as a volume resistivity ρ [Ω·cm] of the conductive layer 202.

$$\rho=1/(I-I_0)\times S/d(\Omega\cdot\text{cm}) \quad (4)$$

In the formula, $I_0$ represents a background current value (A) when a voltage is not applied between the copper tape 203 and the support 201; I represents a current value (A) when only a direct-current voltage (direct-current component) of −1 V is applied; d represents a thickness (cm) of the conductive layer 202; and S represents an area (cm$^2$) of the front side electrode (copper tape 203) of the conductive layer 202.

In this measurement, a very small current value of $1\times10^{-6}$ A or less expressed in terms of absolute value is measured. Therefore, the ammeter 207 is a device capable of measuring minute current. Examples of the device include a pA meter (trade name: 4140B) manufactured by Yokogawa Hewlett-Packard and a high resistance meter (trade name: 4339B) manufactured by Agilent Technologies.

The volume resistivity of the conductive layer measured in a structure in which only the conductive layer is formed on the support is equal to the volume resistivity measured in a structure in which layers (e.g., photosensitive layer) on the conductive layer are removed from the electrophotographic photosensitive member and only the conductive layer is left on the support.

Undercoat Layer

An undercoat layer having electrical barrier properties may be disposed between the conductive layer and the photosensitive layer to prevent charges from being injected into the photosensitive layer from the conductive layer.

The undercoat layer can be formed by applying an undercoat layer-forming coating solution containing a resin (binder resin) onto the conductive layer to form a coating film and then drying the resulting coating film.

Examples of the resin (binder resin) used for the undercoat layer include polyvinyl alcohol, polyvinyl methyl ether, polyacrylic acid, methyl cellulose, ethyl cellulose, polyglutamic acid, casein, polyamide, polyimide, polyamide-imide, polyamic acid, melamine resin, epoxy resin, polyurethane, and polyglutamic acid ester. Among them, a heat-curable resin is particularly used. Among the heat-curable resins, a heat-curable polyamide is particularly used. The polyamide is, for example, a copolymer nylon.

The thickness of the undercoat layer can be 0.1 μm or more and 2 μm or less. The undercoat layer may contain an electron transport material (electron accepting material such as acceptor) to cause charges to smoothly flow in the undercoat layer. Examples of the electron transport material include 2,4,7-trinitrofluorenone, 2,4,5,7-tetranitrofluorenone, chloranil, and tetracyanoquinodimethane.

Photosensitive Layer

A photosensitive layer is disposed on the conductive layer or the undercoat layer.

Examples of the charge generation material used for the photosensitive layer include azo pigments, phthalocyanine pigments, indigo pigments, perylene pigments, polycyclic quinone pigments, squarylium dyes, pyrylium salts, thiapyrilium salts, triphenylmethane dyes, quinacridone pigments, azulenium salt pigments, cyanine dyes, xanthene dyes, quinoneimine dyes, and styryl dyes. Among them, metal phthalocyanines such as oxytitanium phthalocyanine, hydroxygallium phthalocyanine, and chlorogallium phthalocyanine are particularly used.

When the photosensitive layer is a multilayer type photosensitive layer, the charge generating layer can be formed by applying a charge generating layer-forming coating solution prepared by dispersing a charge generation material and a binder resin in a solvent to form a coating film and then drying the resulting coating film. The dispersion is performed with, for example, a homogenizer, an ultrasonic disperser, a ball mill, a sand mill, an attritor, or a roll mill.

Examples of the binder resin used for the charge generating layer include polycarbonate, polyester, polyarylate, butyral resin, polystyrene, polyvinyl acetal, diallyl phthalate resin, acrylic resin, methacrylic resin, vinyl acetate resin, phenolic resin, silicone resin, polysulfone, styrene-butadiene copolymers, alkyd resin, epoxy resin, urea resin, and vinyl chloride-vinyl acetate copolymers. These resins may be used alone or in combination of two or more as a mixture or a copolymer.

The mass ratio of the charge generation material and the binder resin (charge generation material:binder resin) is preferably in the range of 10:1 to 1:10 and more preferably in the range of 5:1 to 1:1.

Examples of the solvent used for the charge generating layer-forming coating solution include alcohols, sulfoxides, ketones, ethers, esters, halogenated aliphatic hydrocarbons, and aromatic compounds.

The thickness of the charge generating layer is preferably 5 μm or less and more preferably 0.1 μm or more and 2 μm or less.

The charge generating layer may optionally contain various additive agents such as a sensitizer, an antioxidant, an ultraviolet absorber, and a plasticizer. The charge generating layer may also contain an electron transport material (electron accepting material such as acceptor) to cause charges to smoothly flow in the charge generating layer. The electron transport material is, for example, the above-described electron transport material used for the undercoat layer.

Examples of the charge transport material used for the photosensitive layer include triarylamine compounds, hydrazone compounds, styryl compounds, stilbene compounds, pyrazoline compounds, oxazole compounds, thiazole compounds, and triallylmethane compounds.

When the photosensitive layer is a multilayer type photosensitive layer, the charge transporting layer can be formed by applying a charge transporting layer-forming coating solution prepared by dissolving a charge transport material and a binder resin in a solvent to form a coating film and then drying the resulting coating film.

Examples of the binder resin used for the charge transporting layer include acrylic resin, styrene resin, polyester, polycarbonate, polyarylate, polysulfone, polyphenylene oxide, epoxy resin, polyurethane, and alkyd resin. These resins may be used alone or in combination of two or more as a mixture or a copolymer.

The mass ratio of the charge transport material and the binder resin (charge transport material:binder resin) can be in the range of 2:1 to 1:2.

Examples of the solvent used for the charge transporting layer-forming coating solution include ketone solvents, ester solvents, ether solvents, aromatic hydrocarbon solvents, and hydrocarbon solvents substituted with a halogen atom.

The thickness of the charge transporting layer is preferably 3 μm or more and 40 μm or less and more preferably 4 μm or more and 30 μm or less.

The charge transporting layer may optionally contain an antioxidant, an ultraviolet absorber, and a plasticizer.

When the photosensitive layer is a single-layer type photosensitive layer, the single-layer type photosensitive layer can be formed by applying a single-layer type photosensitive layer-forming coating solution containing a charge generation material, a charge transport material, a binder resin, and a solvent and then drying the resulting coating film. The charge generation material, the charge transport material, the binder resin, and the solvent may be those described above.

A protective layer may be disposed on the photosensitive layer to protect the photosensitive layer.

The protective layer can be formed by applying a protective layer-forming coating solution containing a resin (binder resin) to form a coating film and then drying and/or curing the resulting coating film.

The thickness of the protective layer is preferably 0.5 μm or more and 10 μm or less and more preferably 1 μm or more and 8 μm or less.

The coating solution for each of the layers can be applied by dipping (dip coating), spray coating, spinner coating, roller coating, Meyer bar coating, blade coating, or the like.

Figure 1:
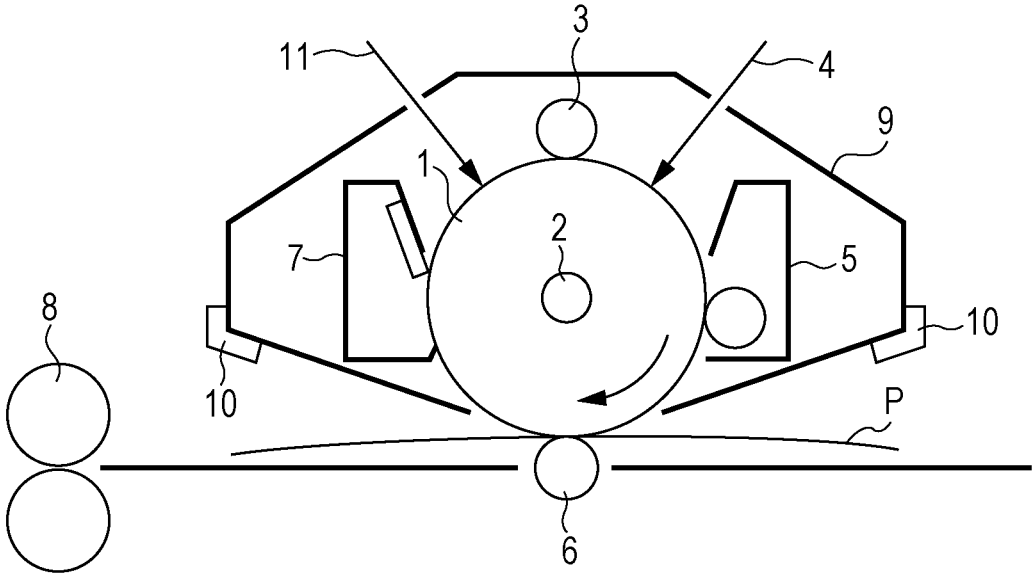
FIG. 1 illustrates an example of a schematic structure of an electrophotographic apparatus that includes a process cartridge including an electrophotographic photosensitive member.

FIG. 1 illustrates an example of a schematic structure of an electrophotographic apparatus that includes a process cartridge including an electrophotographic photosensitive member.

In FIG. 1, a drum-shaped (cylindrical) electrophotographic photosensitive member 1 is rotated about a shaft 2 at a predetermined peripheral speed in a direction indicated by an arrow.

The peripheral surface of the rotated electrophotographic photosensitive member 1 is uniformly charged at a predetermined positive or negative potential by a charging device (first charging device such as a charging roller) 3. The electrophotographic photosensitive member 1 is then irradiated with exposure light (image exposure light) 4 emitted from an exposing device (not illustrated) such as a slit exposing device or a laser beam scanning exposing device. Thus, electrostatic latent images corresponding to intended images are successively formed on the peripheral surface of the electrophotographic photosensitive member 1. The voltage applied to the charging device 3 may be only a direct-current voltage or a direct-current voltage obtained by superimposing an alternating voltage.

The electrostatic latent images formed on the peripheral surface of the electrophotographic photosensitive member 1 are subjected to development with a toner contained in a developing device 5 and are made visible as toner images. The toner images formed on the peripheral surface of the electrophotographic photosensitive member 1 are then transferred onto a transfer material (e.g., paper) P by a transfer bias from a transfer device (e.g., transfer roller) 6. The transfer material P is fed to a portion (contact portion) between the electrophotographic photosensitive member 1 and the transfer device 6 from a transfer material feeding device (not illustrated) in synchronism with the rotation of the electrophotographic photosensitive member 1.

The transfer material P onto which toner images have been transferred is separated from the peripheral surface of the electrophotographic photosensitive member 1 and is conveyed to a fixing device 8. After the toner images are fixed, the transfer material P is output from the electrophotographic apparatus as an image-formed article (such as a print or a copy).

The peripheral surface of the electrophotographic photosensitive member 1 after the toner images have been transferred is cleaned by removing an untransferred residual toner with a cleaning member (e.g., cleaning blade) 7. The electricity on the peripheral surface of the electrophotographic photosensitive member 1 is removed with pre-exposure light 11 from a pre-exposing device (not illustrated), and then the electrophotographic photosensitive member 1 is repeatedly used for image forming. In the case where the charging device is a contact charging device such as a charging roller, pre-exposure is not necessarily required. Furthermore, if the electrophotographic apparatus employs a cleanerless system, the cleaning member is not necessarily required.

The electrophotographic photosensitive member 1 and at least one component selected from the charging device 3, the developing device 5, and the cleaning member 7 may be incorporated in a container and integrally supported to provide a process cartridge. The process cartridge may be detachably attachable to the main body of an electrophotographic apparatus. In FIG. 1, the electrophotographic photosensitive member 1 and the charging device 3, the developing device 5, and the cleaning member 7 are integrally supported to provide a process cartridge 9, which is detachably attachable to the main body of an electrophotographic apparatus using a guide unit 10 such as a rail of the main body.

EXAMPLES

Hereafter, the present invention will be further described in detail based on specific Examples, but is not limited thereto. In Examples and Comparative Examples, "part" means "part by mass". In Tables, the unit "%" of the coating ratio means "mass %". The unit "%" of the doping ratio (doping amount) means "mass %". In Examples and Tables, the density is determined by the above-described method and is expressed in units of "g/cm$^3$".

Preparation Examples of Conductive Layer-Forming Coating Solution

Preparation Example of Conductive Layer-Forming Coating Solution CP-1

Into a sand mill, 133.09 parts of P-doped tin oxide-coated zinc oxide particles (volume-average particle size: 230 nm, powder resistivity: 5000 Ω·cm, the amount (doping ratio) of phosphorus with which tin oxide is doped: 4.50 mass %, coating ratio: 45 mass %, density: 6.06 g/cm$^3$) serving as first metal oxide particles, 2.98 parts of P-doped tin oxide particles (volume-average particle size: 20 nm, powder resistivity: 200 Ω·cm, the amount (doping ratio) of phosphorus with which tin oxide is doped: 3.60 mass %, density: 6.77 g/cm$^3$) serving as second metal oxide particles, 266.67 parts of a phenolic resin (trade name: Plyophen J-325 manufactured by DIC Corporation, resin solid content: 60 mass %) serving as a binder material, and 120 parts of 1-methoxy-2-propanol serving as a solvent were inserted together with 465 parts of glass beads having a diameter of 0.8 mm. A dispersion treatment was performed under dispersion treatment conditions of disc rotational speed: 2000 rpm, dispersion treatment time: 4.5 hours, and temperature of cooling water: 18° C. to obtain a dispersion liquid.

After the glass beads were removed from the dispersion liquid with a mesh, 5.00 parts of silicone resin particles (trade name: Tospearl 120 manufactured by Momentive Performance Materials Inc., volume-average particle size: 2 μm) serving as a surface roughening material were added to the dispersion liquid. Furthermore, 0.30 parts of silicone oil (trade name: SH28PA manufactured by Dow Corning Toray Co., Ltd.) serving as a leveling agent was added to the dispersion liquid, and stirring was performed for 30 minutes to prepare a conductive layer-forming coating solution CP-1.

Preparation Examples of Conductive Layer-Forming Coating Solutions CP-2 to CP-19

The type (including coating ratio, doping ratio, and density, the same applies hereafter) and amount of the first metal oxide particles, the type (including doping ratio and density, the same applies hereafter) and amount of the second metal oxide particles, and the amount of the binder material were changed to those listed in Table 1. Except for the above changes, conductive layer-forming coating solutions CP-2 to CP-19 were prepared in the same manner as in Preparation Example of the conductive layer-forming coating solution CP-1. The powder resistivity of the P-doped tin oxide-coated zinc oxide particles serving as the first metal oxide particles used for the preparation of conductive layer-forming coating solutions CP-2 to CP-19 was 5000 Ω·cm. The powder resistivity of the P-doped tin oxide particles (doping ratio: 4.05 mass %, density: 6.74 g/cm$^3$) used as the second metal oxide particles was 250 Ω·cm. The powder resistivity of the P-doped tin oxide particles (doping ratio: 4.50 mass %, density: 6.72 g/cm$^3$) used as the second metal oxide particles was 200 Ω·cm. The powder resistivity of the P-doped tin oxide particles (doping ratio: 4.95 mass %, density: 6.70 g/cm$^3$) used as the second metal oxide particles was 150 Ω·cm. The powder resistivity of the P-doped tin oxide particles (doping ratio: 5.40 mass %, density: 6.67 g/cm$^3$) used as the second metal oxide particles was 100 Ω·cm.

Preparation Examples of Conductive Layer-Forming Coating Solutions CP-20 to CP-22

The type and amount of the first metal oxide particles, the type and amount of the second metal oxide particles, the amount of the binder material, and the amount of the silicone resin particles were changed to those listed in Table 1. Furthermore, 30.00 parts of uncoated zinc oxide particles (powder resistivity: $2.0\times10^8$ Ω·cm, volume-average particle size: 210 nm, density: 5.61 g/cm$^3$) were added during the dispersion treatment, and the dispersion treatment was performed. Except for the above changes, conductive layer-forming coating solutions CP-20 to CP-22 were prepared in the same manner as in Preparation Example of the conductive layer-forming coating solution CP-1. In the preparation of the conductive layer-forming coating solution CP-21, the disc rotational speed was changed to 2500 rpm and the dispersion treatment time was changed to 10 hours. In the preparation of the conductive layer-forming coating solution CP-22, the disc rotational speed was changed to 2500 rpm and the dispersion treatment time was changed to 30 hours.

Preparation Examples of Conductive Layer-Forming Coating Solutions CP-C1 to CP-C12

The type and amount of the first metal oxide particles, the type and amount of the second metal oxide particles, and the amount of the binder material were changed to those listed in Table 2 (including changes of use/nonuse of the first metal oxide particles and the second metal oxide particles, the same applies hereafter). Except for the above changes, conductive layer-forming coating solutions CP-C1 to CP-C12 were prepared in the same manner as in Preparation Example of the conductive layer-forming coating solution CP-1. The powder resistivity of the P-doped tin oxide-coated zinc oxide particles serving as the first metal oxide particles used for the preparation of the conductive layer-forming coating solutions was 5000 Ω·cm. The powder resistivity of the P-doped tin oxide particles (doping ratio: 4.50 mass %, density: 6.72 g/cm$^3$) used as the second metal oxide particles was 200 Ω·cm.

The powder resistivity of oxygen-deficient tin oxide-coated zinc oxide particles serving as the first metal oxide particles used for the preparation of the conductive layer-forming coating solutions was 5000 Ω·cm. The powder resistivity of oxygen-deficient tin oxide-coated barium sulfate particles serving as the first metal oxide particles used for the preparation of the conductive layer-forming coating solutions was 5000 Ω·cm. The powder resistivity of Sb-doped tin oxide-coated zinc oxide particles serving as the first metal oxide particles used for the preparation of the conductive layer-forming coating solutions was 3000 Ω·cm.

The powder resistivity of oxygen-deficient tin oxide particles serving as the second metal oxide particles used for the preparation of the conductive layer-forming coating solutions was 200 Ω·cm. The powder resistivity of indium tin oxide particles serving as the second metal oxide particles used for the preparation of the conductive layer-forming coating solutions was 100 Ω·cm. The powder resistivity of Sb-doped tin oxide particles serving as the second metal oxide particles used for the preparation of the conductive layer-forming coating solutions was 100 Ω·cm.

The powder resistivity of W-doped tin oxide-coated zinc oxide particles (doping ratio: 4.50 mass %, coating ratio: 45 mass %, density: 6.33 g/cm$^3$) serving as the first metal oxide particles used for the preparation of the conductive layer-forming coating solutions was 3000 Ω·cm. The powder resistivity of F-doped tin oxide-coated zinc oxide particles (doping ratio: 4.50 mass %, coating ratio: 45 mass %, density: 6.03 g/cm$^3$) serving as the first metal oxide particles used for the preparation of the conductive layer-forming coating solutions was 5000 Ω·cm.

Preparation Examples of Conductive Layer-Forming Coating Solutions CP-23 to CP-27

The type (including coating ratio, doping ratio, and density, the same applies hereafter) and amount of the first metal oxide particles, the type (including doping ratio and density, the same applies hereafter) and amount of the second metal oxide particles, and the amount of the binder material were changed to those listed in Table 1. Except for the above changes, conductive layer-forming coating solutions CP-23 to CP-27 were prepared in the same manner as in Preparation Example of the conductive layer-forming coating solution CP-1. The powder resistivity of P-doped tin oxide-coated tin oxide particles serving as the first metal oxide particles used for the preparation of the conductive layer-forming coating solutions CP-23 to CP-27 was 5000 Ω·cm. The powder resistivity of the P-doped tin oxide particles (doping ratio: 4.50 mass %, coating ratio: 45 mass %, density: 6.72 g/cm$^3$) used as the second metal oxide particles was 200 Ω·cm.

Preparation Examples of Conductive Layer-Forming Coating Solutions CP-C13 to CP-C18

The type and amount of the first metal oxide particles, the type and amount of the second metal oxide particles, and the amount of the binder material were changed to those listed in Table 2. Except for the above changes, conductive layer-forming coating solutions CP-C13 to CP-C18 were prepared in the same manner as in Preparation Example of the conductive layer-forming coating solution CP-1. The powder resistivity of the P-doped tin oxide-coated tin oxide particles serving as the first metal oxide particles used for the preparation of the conductive layer-forming coating solutions was 5000 Ω·cm. The powder resistivity of the P-doped tin oxide particles (doping ratio: 4.50 mass %, density: 6.72 g/cm$^3$) used as the second metal oxide particles was 200 Ω·cm.

In Tables, for example, zinc oxide particles coated with oxygen-deficient tin oxide (oxygen-deficient tin oxide-coated zinc oxide particles) do not correspond to the first metal oxide particles according to an embodiment of the present invention, but are listed in corresponding columns as examples compared to the present invention for the sake of convenience. Furthermore, oxygen-deficient tin oxide particles and the like do not correspond to the second metal oxide particles according to an embodiment of the present invention, but are listed in corresponding columns as examples compared to the present invention for the sake of convenience.

TABLE 1

| Conductive layer- | (1) First metal oxide particles | | | | | (2) Second metal oxide particles | | | |
|---|---|---|---|---|---|---|---|---|---|
| forming coating solution | Type | Coating ratio % | Doping ratio % | Density g/cm$^3$ | Part by mass | Type | Doping ratio % | Density g/cm$^3$ | Part by mass |
| CP-1 | P-doped tin | 45 | 4.50 | 6.06 | 133.09 | P-doped | 4.50 | 6.72 | 2.96 |
| CP-2 | oxide-coated | 45 | 4.50 | 6.06 | 128.93 | tin oxide | 4.50 | 6.72 | 7.17 |
| CP-3 | zinc oxide | 45 | 4.50 | 6.06 | 118.71 | particles | 4.50 | 6.72 | 17.11 |
| CP-4 | particles | 45 | 4.50 | 6.06 | 106.23 | (volume- | 4.50 | 6.72 | 29.49 |
| CP-5 | (volume- | 45 | 4.50 | 6.06 | 143.19 | average | 3.60 | 6.77 | 20.79 |
| CP-6 | average | 45 | 4.50 | 6.06 | 143.31 | particle | 4.05 | 6.74 | 20.73 |
| CP-7 | particle | 45 | 4.50 | 6.06 | 143.31 | size: 20 nm) | 4.50 | 6.72 | 20.66 |
| CP-8 | size: 230 nm) | 45 | 4.50 | 6.06 | 143.31 | | 4.95 | 6.70 | 20.59 |
| CP-9 | | 45 | 4.50 | 6.06 | 143.31 | | 5.40 | 6.67 | 20.52 |
| CP-10 | | 45 | 4.50 | 6.06 | 133.80 | | 4.50 | 6.72 | 29.69 |
| CP-11 | | 45 | 4.50 | 6.06 | 203.79 | | 4.50 | 6.72 | 4.51 |
| CP-12 | | 45 | 4.50 | 6.06 | 196.90 | | 4.50 | 6.72 | 10.93 |
| CP-13 | | 45 | 4.50 | 6.06 | 180.56 | | 4.50 | 6.72 | 26.03 |
| CP-14 | | 45 | 4.50 | 6.06 | 168.38 | | 4.50 | 6.72 | 37.36 |
| CP-15 | | 45 | 4.50 | 6.06 | 160.60 | | 4.50 | 6.72 | 44.53 |
| CP-16 | | 45 | 4.50 | 6.06 | 226.79 | | 4.50 | 6.72 | 12.59 |
| CP-17 | | 45 | 4.50 | 6.06 | 247.46 | | 4.50 | 6.72 | 5.58 |
| CP-18 | | 45 | 4.50 | 6.06 | 218.53 | | 4.50 | 6.72 | 31.49 |
| CP-19 | | 45 | 4.50 | 6.06 | 193.69 | | 4.50 | 6.72 | 53.71 |
| CP-20 | | 45 | 4.50 | 6.06 | 186.56 | | 4.50 | 6.72 | 26.93 |

TABLE 1-continued

| | | | | | | | | | |
|---|---|---|---|---|---|---|---|---|---|
| CP-21 | | 45 | 4.50 | 6.06 | 186.56 | | 4.50 | 6.72 | 26.93 |
| CP-22 | | 45 | 4.50 | 6.06 | 191.32 | | 4.50 | 6.72 | 22.92 |
| CP-23 | P-doped tin | 45 | 4.50 | 6.84 | 134.07 | P-doped | 4.50 | 6.72 | 17.11 |
| CP-24 | oxide-coated | 45 | 4.50 | 6.84 | 230.16 | tin oxide | 4.50 | 6.72 | 4.51 |
| CP-25 | tin oxide | 45 | 4.50 | 6.84 | 203.92 | particles | 4.50 | 6.72 | 26.03 |
| CP-26 | particles | 45 | 4.50 | 6.84 | 181.38 | (volume- | 4.50 | 6.72 | 44.53 |
| CP-27 | (volume- | 45 | 4.50 | 6.84 | 246.80 | average | 4.50 | 6.72 | 31.49 |
| | average | | | | | particle | | | |
| | particle | | | | | size: 20 nm) | | | |
| | size: 230 nm) | | | | | | | | |

| | (3) Binder material | | (4) | | (5) | | |
|---|---|---|---|---|---|---|---|
| Conductive layer- | | Part by mass (resin solid | Silicone resin particles | | Particles other than (1) to (4) | | |
| forming coating solution | Density g/cm$^3$ | content is 60 mass % of the following value) | Density g/cm$^3$ | Part by mass | Type | Density g/cm$^3$ | Part by mass |
| CP-1 | 1.30 | 266.75 | 1.3 | 5.00 | No | | |
| CP-2 | 1.30 | 265.58 | 1.3 | 5.00 | | | |
| CP-3 | 1.30 | 263.40 | 1.3 | 5.00 | | | |
| CP-4 | 1.30 | 260.33 | 1.3 | 5.00 | | | |
| CP-5 | 1.30 | 222.67 | 1.3 | 5.00 | | | |
| CP-6 | 1.30 | 223.00 | 1.3 | 5.00 | | | |
| CP-7 | 1.30 | 223.00 | 1.3 | 5.00 | | | |
| CP-8 | 1.30 | 223.00 | 1.3 | 5.00 | | | |
| CP-9 | 1.30 | 223.00 | 1.3 | 5.00 | | | |
| CP-10 | 1.30 | 221.33 | 1.3 | 5.00 | | | |
| CP-11 | 1.30 | 165.00 | 1.3 | 5.00 | | | |
| CP-12 | 1.30 | 164.00 | 1.3 | 5.00 | | | |
| CP-13 | 1.30 | 161.83 | 1.3 | 5.00 | | | |
| CP-14 | 1.30 | 160.08 | 1.3 | 5.00 | | | |
| CP-15 | 1.30 | 159.08 | 1.3 | 5.00 | | | |
| CP-16 | 1.30 | 119.33 | 1.3 | 5.00 | | | |
| CP-17 | 1.30 | 101.98 | 1.3 | 5.00 | | | |
| CP-18 | 1.30 | 99.50 | 1.3 | 5.00 | | | |
| CP-19 | 1.30 | 97.42 | 1.3 | 5.00 | | | |
| CP-20 | 1.30 | 93.58 | 1.3 | 40.0 | Uncoated | 5.61 | 30.00 |
| CP-21 | 1.30 | 93.58 | 1.3 | 40.0 | zinc oxide | 5.61 | 30.00 |
| CP-22 | 1.30 | 93.58 | 1.3 | 40.0 | particles | 5.61 | 30.00 |
| | | | | | (volume- | | |
| | | | | | average | | |
| | | | | | particle | | |
| | | | | | size: 210 nm) | | |
| CP-23 | 1.30 | 263.40 | 1.3 | 5.00 | No | | |
| CP-24 | 1.30 | 165.00 | 1.3 | 5.00 | | | |
| CP-25 | 1.30 | 161.83 | 1.3 | 5.00 | | | |
| CP-26 | 1.30 | 159.08 | 1.3 | 5.00 | | | |
| CP-27 | 1.30 | 99.50 | 1.3 | 5.00 | | | |

TABLE 2

| Conductive layer- | (1) First metal oxide particles | | | | | (2) Second metal oxide particles | | | |
|---|---|---|---|---|---|---|---|---|---|
| forming coating solution | Type | Coating ratio % | Doping ratio % | Density g/cm$^3$ | Part by mass | Type | Doping ratio % | Density g/cm$^3$ | Part by mass |
| CP-C1 | P-doped tin | 45 | 4.50 | 6.06 | 208.67 | No | — | — | — |
| CP-C2 | oxide-coated | 45 | 4.50 | 6.06 | 206.17 | P-doped | 4.50 | 6.72 | 2.28 |
| CP-C3 | zinc oxide | 45 | 4.50 | 6.06 | 153.53 | tin oxide | 4.50 | 6.72 | 51.10 |
| | particles | | | | | particles | | | |
| | (average | | | | | (average | | | |
| | particle | | | | | particle | | | |
| | size: 230 nm) | | | | | size: 20 nm) | | | |
| CP-C4 | No | — | — | — | | | 4.50 | 6.72 | 193.36 |
| CP-C5 | P-doped tin | 45 | 4.50 | 6.06 | 88.53 | | 4.50 | 6.72 | 12.79 |
| CP-C6 | oxide-coated | 45 | 4.50 | 6.06 | 228.09 | | 4.50 | 6.72 | 32.90 |
| | zinc oxide | | | | | | | | |
| | particles | | | | | | | | |
| | (average | | | | | | | | |
| | particle | | | | | | | | |
| | size: 230 nm) | | | | | | | | |

TABLE 2-continued

| | | | | | | | | | |
|---|---|---|---|---|---|---|---|---|---|
| CP-C7 | Oxygen-deficient tin oxide-coated zinc oxide particles (average particle size: 230 nm) | 45 | — | 6.14 | 183.00 | P-doped tin oxide particles (average particle size: 20 nm) | 4.50 | 6.72 | 26.08 |
| CP-C8 | Sb-doped tin oxide-coated zinc oxide particles (average particle size: 230 nm) | 45 | 4.50 | 6.10 | 181.80 | P-doped tin oxide particles (average particle size: 20 nm) | 4.50 | 6.72 | 26.08 |
| CP-C9 | P-doped tin oxide-coated zinc oxide particles (average particle size: 230 nm) | 45 | 4.50 | 6.06 | 179.54 | Indium tin oxide particles (average particle size: 20 nm) | 4.50 | 7.10 | 27.35 |
| CP-C10 | P-doped tin oxide-coated zinc oxide particles (average particle size: 230 nm) | 45 | 4.50 | 6.06 | 180.85 | Sb-doped tin oxide particles (average particle size: 20 nm) | 4.50 | 6.60 | 25.60 |
| CP-C11 | W-doped tin oxide-coated zinc oxide particles (average particle size: 230 nm) | 45 | 4.50 | 6.33 | 186.61 | P-doped tin oxide particles (average particle size: 20 nm) | 4.50 | 6.72 | 25.78 |
| CP-C12 | P-doped tin oxide-coated zinc oxide particles (average particle size: 230 nm) | 45 | 4.50 | 6.06 | 180.85 | F-doped tin oxide particles (average particle size: 20 nm) | 4.50 | 6.64 | 25.76 |
| CP-C13 | P-doped tin | 45 | 4.50 | 6.84 | 235.66 | No | — | — | — |
| CP-C14 | oxide-coated | 45 | 4.50 | 6.84 | 232.84 | P-doped | 4.50 | 6.72 | 2.28 |
| CP-C15 | tin oxide | 45 | 4.50 | 6.84 | 173.39 | tin oxide | 4.50 | 6.72 | 51.10 |
| CP-C16 | particles | 45 | 4.50 | 6.84 | 99.98 | particles | 4.50 | 6.72 | 12.79 |
| CP-C17 | (average particle size: 230 nm) | 45 | 4.50 | 6.84 | 257.60 | (average particle size: 20 nm) | 4.50 | 6.72 | 32.90 |
| CP-C18 | No | — | — | — | — | | 4.50 | 6.72 | 193.36 |

| | (3) Binder material | | (4) | | (5) | | |
|---|---|---|---|---|---|---|---|
| Conductive layer-forming coating solution | Density g/cm$^3$ | Part by mass (resin solid content is 60 mass % of the following value) | Silicone resin particles Density g/cm$^3$ | Silicone resin particles Part by mass | Particles other than (1) to (4) Type | Particles other than (1) to (4) Density g/cm$^3$ | Particles other than (1) to (4) Part by mass |
| CP-C1 | 1.3 | 165.67 | 1.3 | 5.00 | | No | |
| CP-C2 | 1.3 | 165.38 | 1.3 | 5.00 | | | |
| CP-C3 | 1.3 | 158.08 | 1.3 | 5.00 | | | |
| CP-C4 | 1.3 | 137.00 | 1.3 | 5.00 | | | |
| CP-C5 | 1.3 | 312.92 | 1.3 | 5.00 | | | |
| CP-C6 | 1.3 | 83.75 | 1.3 | 5.00 | | | |
| CP-C7 | 1.3 | 161.67 | 1.3 | 5.00 | | | |
| CP-C8 | 1.3 | 161.67 | 1.3 | 5.00 | | | |
| CP-C9 | 1.3 | 160.92 | 1.3 | 5.00 | | | |
| CP-C10 | 1.3 | 162.00 | 1.3 | 5.00 | | | |
| CP-C11 | 1.3 | 160.00 | 1.3 | 5.00 | | | |
| CP-C12 | 1.3 | 162.00 | 1.3 | 5.00 | | | |
| CP-C13 | 1.3 | 165.67 | 1.3 | 5.00 | | No | |
| CP-C14 | 1.3 | 165.38 | 1.3 | 5.00 | | | |
| CP-C15 | 1.3 | 158.08 | 1.3 | 5.00 | | | |
| CP-C16 | 1.3 | 312.92 | 1.3 | 5.00 | | | |

TABLE 2-continued

| | | | | |
|---|---|---|---|---|
| CP-C17 | 1.3 | 83.75 | 1.3 | 5.00 |
| CP-C18 | 1.3 | 137.00 | 1.3 | 5.00 |

Preparation Examples of Conductive Layer-Forming Coating Solutions CP-28 to CP-32

The type (including coating ratio, doping ratio, and density, the same applies hereafter) and amount of the first metal oxide particles, the type (including doping ratio and density, the same applies hereafter) and amount of the second metal oxide particles, and the amount of the binder material were changed to those listed in Table 3. Except for the above changes, conductive layer-forming coating solutions CP-28 to CP-32 were prepared in the same manner as in Preparation Example of the conductive layer-forming coating solution CP-1. The powder resistivity of W-doped tin oxide-coated zinc oxide particles serving as the first metal oxide particles used for the preparation of the conductive layer-forming coating solutions CP-28 to CP-32 was 3000 Ω·cm. The powder resistivity of W-doped tin oxide particles (doping ratio: 4.50 mass %, density: 7.51 g/cm$^3$) used as the second metal oxide particles was 100 Ω·cm.

Preparation Examples of Conductive Layer-Forming Coating Solutions CP-C19 to CP-C24

The type and amount of the first metal oxide particles, the type and amount of the second metal oxide particles, and the amount of the binder material were changed to those listed in Table 3. Except for the above changes, conductive layer-forming coating solutions CP-C19 to CP-C24 were prepared in the same manner as in Preparation Example of the conductive layer-forming coating solution CP-1. The powder resistivity of W-doped tin oxide-coated zinc oxide particles serving as the first metal oxide particles used for the preparation of the conductive layer-forming coating solutions was 3000 Ω·cm. The powder resistivity of W-doped tin oxide particles (doping ratio: 4.50 mass %, density: 7.51 g/cm$^3$) used as the second metal oxide particles was 100 Ω·cm.

Preparation Examples of Conductive Layer-Forming Coating Solutions CP-33 to CP-37

The type (including coating ratio, doping ratio, and density, the same applies hereafter) and amount of the first metal oxide particles, the type (including doping ratio and density, the same applies hereafter) and amount of the second metal oxide particles, and the amount of the binder material were changed to those listed in Table 3. Except for the above changes, conductive layer-forming coating solutions CP-33 to CP-37 were prepared in the same manner as in Preparation Example of the conductive layer-forming coating solution CP-1. The powder resistivity of W-doped tin oxide-coated tin oxide particles serving as the first metal oxide particles used for the preparation of the conductive layer-forming coating solutions CP-33 to CP-37 was 3000 Ω·cm. The powder resistivity of W-doped tin oxide particles (doping ratio: 4.50 mass %, density: 7.51 g/cm$^3$) used as the second metal oxide particles was 100 Ω·cm.

Preparation Examples of Conductive Layer-Forming Coating Solutions CP-C25 to CP-C30

The type and amount of the first metal oxide particles, the type and amount of the second metal oxide particles, and the amount of the binder material were changed to those listed in Table 3. Except for the above changes, conductive layer-forming coating solutions CP-C25 to CP-C30 were prepared in the same manner as in Preparation Example of the conductive layer-forming coating solution CP-1. The powder resistivity of W-doped tin oxide-coated tin oxide particles serving as the first metal oxide particles used for the preparation of the conductive layer-forming coating solutions was 3000 Ω·cm. The powder resistivity of W-doped tin oxide particles (doping ratio: 4.50 mass %, density: 7.51 g/cm$^3$) used as the second metal oxide particles was 100 Ω·cm.

TABLE 3

| Conductive layer- | (1) First metal oxide particles | | | | | (2) Second metal oxide particles | | | |
|---|---|---|---|---|---|---|---|---|---|
| forming coating solution | Type | Coating ratio % | Doping ratio % | Density g/cm$^3$ | Part by mass | Type | Doping ratio % | Density g/cm$^3$ | Part by mass |
| CP-28 | W-doped tin | 45 | 4.50 | 6.33 | 123.99 | W-doped | 4.50 | 7.51 | 19.12 |
| CP-29 | oxide-coated | 45 | 4.50 | 6.33 | 212.86 | tin oxide | 4.50 | 7.51 | 5.04 |
| CP-30 | zinc oxide | 45 | 4.50 | 6.33 | 188.60 | particles | 4.50 | 7.51 | 29.09 |
| CP-31 | particles | 45 | 4.50 | 6.33 | 167.75 | (volume- | 4.50 | 7.51 | 49.77 |
| CP-32 | (volume- | 45 | 4.50 | 6.33 | 228.25 | average | 4.50 | 7.51 | 35.20 |
| | average | | | | | particle | | | |
| | particle | | | | | size: 20 nm) | | | |
| CP-C19 | size: 230 nm) | 45 | 4.50 | 6.33 | 217.95 | | No | | |
| CP-C20 | | 45 | 4.50 | 6.33 | 215.34 | W-doped | 4.50 | 7.51 | 2.54 |
| CP-C21 | | 45 | 4.50 | 6.33 | 160.36 | tin oxide | 4.50 | 7.51 | 57.11 |
| CP-C22 | | | No | | | particles | 4.50 | 7.51 | 216.11 |
| CP-C23 | W-doped tin | 45 | 4.50 | 6.33 | 92.47 | (volume- | 4.50 | 7.51 | 14.29 |
| CP-C24 | oxide-coated | 45 | 4.50 | 6.33 | 238.24 | average | 4.50 | 7.51 | 36.77 |
| | zinc oxide | | | | | particle | | | |
| | particles | | | | | size: 20 nm) | | | |
| | (volume- | | | | | | | | |
| | average | | | | | | | | |
| | particle | | | | | | | | |
| | size: 230 nm) | | | | | | | | |
| CP-33 | W-doped tin | 45 | 4.50 | 7.19 | 140.84 | W-doped | 4.50 | 7.51 | 19.12 |
| CP-34 | oxide-coated | 45 | 4.50 | 7.19 | 241.78 | tin oxide | 4.50 | 7.51 | 5.04 |
| CP-35 | tin oxide | 45 | 4.50 | 7.19 | 214.22 | particles | 4.50 | 7.51 | 29.09 |

TABLE 3-continued

| | | | | | | | | | |
|---|---|---|---|---|---|---|---|---|---|
| CP-36 | particles | 45 | 4.50 | 7.19 | 190.54 | (volume- | 4.50 | 7.51 | 49.77 |
| CP-37 | (volume- | 45 | 4.50 | 7.19 | 259.26 | average | 4.50 | 7.51 | 35.20 |
| | average | | | | | particle | | | |
| | particle | | | | | size: 20 nm) | | | |
| CP-C25 | size: 230 nm) | 45 | 4.50 | 7.19 | 247.56 | | No | | |
| CP-C26 | | 45 | 4.50 | 7.19 | 244.60 | W-doped | 4.50 | 7.51 | 2.54 |
| CP-C27 | | 45 | 4.50 | 7.19 | 182.15 | tin oxide | 4.50 | 7.51 | 57.11 |
| CP-C28 | | | No | | | particles | 4.50 | 7.51 | 216.11 |
| CP-C29 | W-doped tin | 45 | 4.50 | 7.19 | 105.03 | (volume- | 4.50 | 7.51 | 14.29 |
| CP-C30 | oxide-coated | 45 | 4.50 | 7.19 | 270.61 | average | 4.50 | 7.51 | 36.77 |
| | tin oxide | | | | | particle | | | |
| | particles | | | | | size: 20 nm) | | | |
| | (volume- | | | | | | | | |
| | average | | | | | | | | |
| | particle | | | | | | | | |
| | size: 230 nm) | | | | | | | | |

| | (3) Binder material | | (4) | | (5) | | |
|---|---|---|---|---|---|---|---|
| Conductive layer- | | Part by mass (resin solid | Silicone resin particles | | Particles other than (1) to (4) | | |
| forming coating solution | Density g/cm$^3$ | content is 60 mass % of the following value) | Density g/cm$^3$ | Part by mass | Type | Density g/cm$^3$ | Part by mass |
| CP-28 | 1.30 | 263.40 | 1.3 | 5.00 | | No | |
| CP-29 | 1.30 | 165.00 | 1.3 | 5.00 | | | |
| CP-30 | 1.30 | 161.83 | 1.3 | 5.00 | | | |
| CP-31 | 1.30 | 159.08 | 1.3 | 5.00 | | | |
| CP-32 | 1.30 | 99.50 | 1.3 | 5.00 | | | |
| CP-C19 | 1.3 | 165.67 | 1.3 | 5.00 | | | |
| CP-C20 | 1.3 | 165.38 | 1.3 | 5.00 | | | |
| CP-C21 | 1.3 | 158.08 | 1.3 | 5.00 | | | |
| CP-C22 | 1.3 | 137.00 | 1.3 | 5.00 | | | |
| CP-C23 | 1.3 | 312.92 | 1.3 | 5.00 | | | |
| CP-C24 | 1.3 | 83.75 | 1.3 | 5.00 | | | |
| CP-33 | 1.30 | 263.40 | 1.3 | 5.00 | | No | |
| CP-34 | 1.30 | 165.00 | 1.3 | 5.00 | | | |
| CP-35 | 1.30 | 161.83 | 1.3 | 5.00 | | | |
| CP-36 | 1.30 | 159.08 | 1.3 | 5.00 | | | |
| CP-37 | 1.30 | 99.50 | 1.3 | 5.00 | | | |
| CP-C25 | 1.3 | 165.67 | 1.3 | 5.00 | | | |
| CP-C26 | 1.3 | 165.38 | 1.3 | 5.00 | | | |
| CP-C27 | 1.3 | 158.08 | 1.3 | 5.00 | | | |
| CP-C28 | 1.3 | 137.00 | 1.3 | 5.00 | | | |
| CP-C29 | 1.3 | 312.92 | 1.3 | 5.00 | | | |
| CP-C30 | 1.3 | 83.75 | 1.3 | 5.00 | | | |

Preparation Examples of Conductive Layer-Forming Coating Solutions CP-38 to CP-42

The type (including coating ratio, doping ratio, and density, the same applies hereafter) and amount of the first metal oxide particles, the type (including doping ratio and density, the same applies hereafter) and amount of the second metal oxide particles, and the amount of the binder material were changed to those listed in Table 4. Except for the above changes, conductive layer-forming coating solutions CP-38 to CP-42 were prepared in the same manner as in Preparation Example of the conductive layer-forming coating solution CP-1. The powder resistivity of F-doped tin oxide-coated zinc oxide particles serving as the first metal oxide particles used for the preparation of the conductive layer-forming coating solutions CP-38 to CP-42 was 5000 Ω·cm. The powder resistivity of F-doped tin oxide particles (doping ratio: 4.50 mass %, density: 6.64 g/cm$^3$) used as the second metal oxide particles was 220 Ω·cm.

Preparation Examples of Conductive Layer-Forming Coating Solutions CP-C31 to CP-C36

The type and amount of the first metal oxide particles, the type and amount of the second metal oxide particles, and the amount of the binder material were changed to those listed in Table 4. Except for the above changes, conductive layer-forming coating solutions CP-C31 to CP-C36 were prepared in the same manner as in Preparation Example of the conductive layer-forming coating solution CP-1. The powder resistivity of F-doped tin oxide-coated zinc oxide particles serving as the first metal oxide particles used for the preparation of the conductive layer-forming coating solutions was 5000 Ω·cm. The powder resistivity of F-doped tin oxide particles (doping ratio: 4.50 mass %, density: 6.64 g/cm$^3$) used as the second metal oxide particles was 220 Ω·cm.

Preparation Examples of Conductive Layer-Forming Coating Solutions CP-43 to CP-47

The type (including coating ratio, doping ratio, and density, the same applies hereafter) and amount of the first metal oxide particles, the type (including doping ratio and density, the same applies hereafter) and amount of the second metal oxide particles, and the amount of the binder material were changed to those listed in Table 4. Except for the above changes, conductive layer-forming coating solutions CP-43 to CP-47 were prepared in the same manner as in Preparation Example of the conductive layer-forming coating solution CP-1. The powder resistivity of F-doped tin oxide-coated tin oxide particles serving as the first metal oxide particles used for the preparation of the conductive layer-forming coating solutions CP-43 to CP-47 was 5000 Ω·cm. The powder resistivity of F-doped tin oxide particles (doping ratio: 4.5 mass %, density: 6.64 g/cm$^3$) used as the second metal oxide particles was 220 Ω·cm.

Preparation Examples of Conductive Layer-Forming Coating Solutions CP-C37 to CP-C42

The type and amount of the first metal oxide particles, the type and amount of the second metal oxide particles, and the amount of the binder material were changed to those listed in Table 4. Except for the above changes, conductive layer-forming coating solutions CP-C37 to CP-C42 were prepared in the same manner as in Preparation Example of the conductive layer-forming coating solution CP-1. The powder resistivity of F-doped tin oxide-coated tin oxide particles serving as the first metal oxide particles used for the preparation of the conductive layer-forming coating solutions was 5000 Ω·cm. The powder resistivity of F-doped tin oxide particles (doping ratio: 4.50 mass %, density: 6.64 g/cm$^3$) used as the second metal oxide particles was 220 Ω·cm.

TABLE 4

| Conductive layer-forming coating solution | (1) First metal oxide particles | | | | | (2) Second metal oxide particles | | | |
|---|---|---|---|---|---|---|---|---|---|
| | Type | Coating ratio % | Doping ratio % | Density g/cm$^3$ | Part by mass | Type | Doping ratio % | Density g/cm$^3$ | Part by mass |
| CP-38 | F-doped tin oxide-coated zinc oxide particles (volume-average particle size: 230 nm) | 45 | 4.50 | 6.03 | 118.12 | F-doped tin oxide particles (volume-average particle size: 20 nm) | 4.50 | 6.64 | 16.91 |
| CP-39 | | 45 | 4.50 | 6.03 | 202.77 | | 4.50 | 6.64 | 4.46 |
| CP-40 | | 45 | 4.50 | 6.03 | 179.66 | | 4.50 | 6.64 | 25.72 |
| CP-41 | | 45 | 4.50 | 6.03 | 159.80 | | 4.50 | 6.64 | 44.00 |
| CP-42 | | 45 | 4.50 | 6.03 | 217.43 | | 4.50 | 6.64 | 31.12 |
| CP-C31 | | 45 | 4.50 | 6.03 | 207.62 | No | | | |
| CP-C32 | | 45 | 4.50 | 6.03 | 205.14 | F-doped tin oxide particles (volume-average particle size: 20 nm) | 4.50 | 6.64 | 2.25 |
| CP-C33 | | 45 | 4.50 | 6.03 | 152.76 | | 4.50 | 6.64 | 50.49 |
| CP-C34 | | No | | | | | 4.50 | 6.64 | 191.07 |
| CP-C35 | F-doped tin oxide-coated zinc oxide particles (volume-average particle size: 230 nm) | 45 | 4.50 | 6.03 | 88.09 | | 4.50 | 6.64 | 12.64 |
| CP-C36 | | 45 | 4.50 | 6.03 | 226.95 | | 4.50 | 6.64 | 32.51 |
| CP-43 | F-doped tin oxide-coated tin oxide particles (volume-average particle size: 230 nm) | 45 | 4.50 | 6.81 | 133.40 | F-doped tin oxide particles (volume-average particle size: 20 nm) | 4.50 | 6.64 | 16.91 |
| CP-44 | | 45 | 4.50 | 6.81 | 229.00 | | 4.50 | 6.64 | 4.46 |
| CP-45 | | 45 | 4.50 | 6.81 | 202.90 | | 4.50 | 6.64 | 25.72 |
| CP-46 | | 45 | 4.50 | 6.81 | 180.47 | | 4.50 | 6.64 | 44.00 |
| CP-47 | | 45 | 4.50 | 6.81 | 245.56 | | 4.50 | 6.64 | 31.12 |
| CP-C37 | | 45 | 4.50 | 6.81 | 234.48 | No | | | |
| CP-C38 | | 45 | 4.50 | 6.81 | 231.67 | F-doped tin oxide particles (volume-average particle size: 20 nm) | 4.50 | 6.64 | 2.25 |
| CP-C39 | | 45 | 4.50 | 6.81 | 172.52 | | 4.50 | 6.64 | 50.49 |
| CP-C40 | | No | | | | | 4.50 | 6.64 | 191.07 |
| CP-C41 | F-doped tin oxide-coated tin oxide particles (volume-average particle size: 230 nm) | 45 | 4.50 | 6.81 | 99.48 | | 4.50 | 6.64 | 12.64 |
| CP-C42 | | 45 | 4.50 | 6.81 | 256.31 | | 4.50 | 6.64 | 32.51 |

| Conductive layer-forming coating solution | (3) Binder material | | (4) Silicone resin particles | | (5) Particles other than (1) to (4) | | |
|---|---|---|---|---|---|---|---|
| | Density g/cm$^3$ | Part by mass (resin solid content is 60 mass % of the following value) | Density g/cm$^3$ | Part by mass | Type | Density g/cm$^3$ | Part by mass |
| CP-38 | 1.30 | 263.40 | 1.3 | 5.00 | No | | |
| CP-39 | 1.30 | 165.00 | 1.3 | 5.00 | | | |
| CP-40 | 1.30 | 161.83 | 1.3 | 5.00 | | | |
| CP-41 | 1.30 | 159.08 | 1.3 | 5.00 | | | |
| CP-42 | 1.30 | 99.50 | 1.3 | 5.00 | | | |
| CP-C31 | 1.30 | 165.67 | 1.3 | 5.00 | | | |
| CP-C32 | 1.30 | 165.38 | 1.3 | 5.00 | | | |
| CP-C33 | 1.30 | 158.08 | 1.3 | 5.00 | | | |
| CP-C34 | 1.30 | 137.00 | 1.3 | 5.00 | | | |
| CP-C35 | 1.30 | 312.92 | 1.3 | 5.00 | | | |

TABLE 4-continued

| | | | | | |
|---|---|---|---|---|---|
| CP-C36 | 1.30 | 83.75 | 1.3 | 5.00 | |
| CP-43 | 1.30 | 263.40 | 1.3 | 5.00 | No |
| CP-44 | 1.30 | 165.00 | 1.3 | 5.00 | |
| CP-45 | 1.30 | 161.83 | 1.3 | 5.00 | |
| CP-46 | 1.30 | 159.08 | 1.3 | 5.00 | |
| CP-47 | 1.30 | 99.50 | 1.3 | 5.00 | |
| CP-C37 | 1.30 | 165.67 | 1.3 | 5.00 | |
| CP-C38 | 1.30 | 165.38 | 1.3 | 5.00 | |
| CP-C39 | 1.30 | 158.08 | 1.3 | 5.00 | |
| CP-C40 | 1.30 | 137.00 | 1.3 | 5.00 | |
| CP-C41 | 1.30 | 312.92 | 1.3 | 5.00 | |
| CP-C42 | 1.30 | 83.75 | 1.3 | 5.00 | |

Preparation Examples of Conductive Layer-Forming Coating Solutions CP-48 to CP-52

The type (including coating ratio, doping ratio, and density, the same applies hereafter) and amount of the first metal oxide particles, the type (including doping ratio and density, the same applies hereafter) and amount of the second metal oxide particles, and the amount of the binder material were changed to those listed in Table 5. Except for the above changes, conductive layer-forming coating solutions CP-48 to CP-52 were prepared in the same manner as in Preparation Example of the conductive layer-forming coating solution CP-1. The powder resistivity of Nb-doped tin oxide-coated zinc oxide particles serving as the first metal oxide particles used for the preparation of the conductive layer-forming coating solutions CP-48 to CP-52 was 6500 Ω·cm. The powder resistivity of Nb-doped tin oxide particles (doping ratio: 4.50 mass %, density: 7.02 g/cm$^3$) used as the second metal oxide particles was 330 Ω·cm.

Preparation Examples of Conductive Layer-Forming Coating Solutions CP-C43 to CP-C48

The type and amount of the first metal oxide particles, the type and amount of the second metal oxide particles, and the amount of the binder material were changed to those listed in Table 5. Except for the above changes, conductive layer-forming coating solutions CP-C43 to CP-C48 were prepared in the same manner as in Preparation Example of the conductive layer-forming coating solution CP-1. The powder resistivity of Nb-doped tin oxide-coated zinc oxide particles serving as the first metal oxide particles used for the preparation of the conductive layer-forming coating solutions was 6500 Ω·cm. The powder resistivity of Nb-doped tin oxide particles (doping ratio: 4.50 mass %, density: 7.02 g/cm$^3$) used as the second metal oxide particles was 330 Ω·cm.

Preparation Examples of Conductive Layer-Forming Coating Solutions CP-53 to CP-57

The type (including coating ratio, doping ratio, and density, the same applies hereafter) and amount of the first metal oxide particles, the type (including doping ratio and density, the same applies hereafter) and amount of the second metal oxide particles, and the amount of the binder material were changed to those listed in Table 5. Except for the above changes, conductive layer-forming coating solutions CP-53 to CP-57 were prepared in the same manner as in Preparation Example of the conductive layer-forming coating solution CP-1. The powder resistivity of Nb-doped tin oxide-coated tin oxide particles serving as the first metal oxide particles used for the preparation of the conductive layer-forming coating solutions CP-53 to CP-57 was 6500 Ω·cm. The powder resistivity of Nb-doped tin oxide particles (doping ratio: 4.50 mass %, density: 7.02 g/cm$^3$) used as the second metal oxide particles was 330 Ω·cm.

Preparation Examples of Conductive Layer-Forming Coating Solutions CP-C49 to CP-C54

The type and amount of the first metal oxide particles, the type and amount of the second metal oxide particles, and the amount of the binder material were changed to those listed in Table 5. Except for the above changes, conductive layer-forming coating solutions CP-C49 to CP-C54 were prepared in the same manner as in Preparation Example of the conductive layer-forming coating solution CP-1. The powder resistivity of Nb-doped tin oxide-coated tin oxide particles serving as the first metal oxide particles used for the preparation of the conductive layer-forming coating solutions was 6500 Ω·cm. The powder resistivity of Nb-doped tin oxide particles (doping ratio: 4.50 mass %, density: 7.02 g/cm$^3$) used as the second metal oxide particles was 330 Ω·cm.

TABLE 5

| Conductive layer- | (1) First metal oxide particles | | | | | (2) Second metal oxide particles | | | |
|---|---|---|---|---|---|---|---|---|---|
| forming coating solution | Type | Coating ratio % | Doping ratio % | Density g/cm$^3$ | Part by mass | Type | Doping ratio % | Density g/cm$^3$ | Part by mass |
| CP-48 | Nb-doped tin | 45 | 4.50 | 6.17 | 120.86 | Nb-doped | 4.50 | 7.02 | 17.87 |
| CP-59 | oxide-coated | 45 | 4.50 | 6.17 | 207.48 | tin oxide | 4.50 | 7.02 | 4.71 |
| CP-50 | zinc oxide | 45 | 4.50 | 6.17 | 183.83 | particles | 4.50 | 7.02 | 27.19 |
| CP-51 | particles | 45 | 4.50 | 6.17 | 163.51 | (volume- | 4.50 | 7.02 | 46.52 |
| CP-52 | (volume- | 45 | 4.50 | 6.17 | 222.48 | average | 4.50 | 7.02 | 32.90 |
| | average | | | | | particle | | | |
| | particle | | | | | size: 20 nm) | | | |
| CP-C43 | size: 230 nm) | 45 | 4.50 | 6.17 | 212.44 | | No | | |
| CP-C44 | | 45 | 4.50 | 6.17 | 209.90 | Nb-doped | 4.50 | 7.02 | 2.38 |
| CP-C45 | | 45 | 4.50 | 6.17 | 156.31 | tin oxide | 4.50 | 7.02 | 53.38 |
| CP-C46 | | | No | | | particles | 4.50 | 7.02 | 202.01 |

TABLE 5-continued

| | | | | | | | | | |
|---|---|---|---|---|---|---|---|---|---|
| CP-C47 | Nb-doped tin | 45 | 4.50 | 6.17 | 90.13 | (volume- | 4.50 | 7.02 | 13.36 |
| CP-C48 | oxide-coated | 45 | 4.50 | 6.17 | 232.22 | average | 4.50 | 7.02 | 34.37 |
| | zinc oxide | | | | | particle | | | |
| | particles | | | | | size: 20 nm) | | | |
| | (volume- | | | | | | | | |
| | average | | | | | | | | |
| | particle | | | | | | | | |
| | size: 230 nm) | | | | | | | | |
| CP-53 | Nb-doped tin | 45 | 4.50 | 6.98 | 136.73 | Nb-doped | 4.50 | 7.02 | 17.87 |
| CP-54 | oxide-coated | 45 | 4.50 | 6.98 | 234.72 | tin oxide | 4.50 | 7.02 | 4.71 |
| CP-55 | tin oxide | 45 | 4.50 | 6.98 | 207.96 | particles | 4.50 | 7.02 | 27.19 |
| CP-56 | particles | 45 | 4.50 | 6.98 | 184.97 | (volume- | 4.50 | 7.02 | 46.52 |
| CP-57 | (volume- | 45 | 4.50 | 6.98 | 251.69 | average | 4.50 | 7.02 | 32.90 |
| | average | | | | | particle | | | |
| | particle | | | | | size: 20 nm) | | | |
| CP-C49 | size: 230 nm) | 45 | 4.50 | 6.98 | 240.33 | | No | | |
| CP-C50 | | 45 | 4.50 | 6.98 | 237.46 | Nb-doped | 4.50 | 7.02 | 2.38 |
| CP-C51 | | 45 | 4.50 | 6.98 | 176.83 | tin oxide | 4.50 | 7.02 | 53.38 |
| CP-C52 | | | No | | | particles | 4.50 | 7.02 | 202.01 |
| CP-C53 | Nb-doped tin | 45 | 4.50 | 6.98 | 101.96 | (volume- | 4.50 | 7.02 | 13.36 |
| CP-C54 | oxide-coated | 45 | 4.50 | 6.98 | 262.71 | average | 4.50 | 7.02 | 34.37 |
| | tin oxide | | | | | particle | | | |
| | particles | | | | | size: 20 nm) | | | |
| | (volume- | | | | | | | | |
| | average | | | | | | | | |
| | particle | | | | | | | | |
| | size: 230 nm) | | | | | | | | |

| | (3) Binder material | | (4) | | (5) | | |
|---|---|---|---|---|---|---|---|
| Conductive layer- | | Part by mass (resin solid | Silicone resin particles | | Particles other than (1) to (4) | | |
| forming coating solution | Density g/cm$^3$ | content is 60 mass % of the following value) | Density g/cm$^3$ | Part by mass | Type | Density g/cm$^3$ | Part by mass |
| CP-48 | 1.30 | 263.40 | 1.3 | 5.00 | | No | |
| CP-59 | 1.30 | 165.00 | 1.3 | 5.00 | | | |
| CP-50 | 1.30 | 161.83 | 1.3 | 5.00 | | | |
| CP-51 | 1.30 | 159.08 | 1.3 | 5.00 | | | |
| CP-52 | 1.30 | 99.50 | 1.3 | 5.00 | | | |
| CP-C43 | 1.30 | 165.67 | 1.3 | 5.00 | | | |
| CP-C44 | 1.30 | 165.38 | 1.3 | 5.00 | | | |
| CP-C45 | 1.30 | 158.08 | 1.3 | 5.00 | | | |
| CP-C46 | 1.30 | 137.00 | 1.3 | 5.00 | | | |
| CP-C47 | 1.30 | 312.92 | 1.3 | 5.00 | | | |
| CP-C48 | 1.30 | 83.75 | 1.3 | 5.00 | | | |
| CP-53 | 1.30 | 263.40 | 1.3 | 5.00 | | No | |
| CP-54 | 1.30 | 165.00 | 1.3 | 5.00 | | | |
| CP-55 | 1.30 | 161.83 | 1.3 | 5.00 | | | |
| CP-56 | 1.30 | 159.08 | 1.3 | 5.00 | | | |
| CP-57 | 1.30 | 99.50 | 1.3 | 5.00 | | | |
| CP-C49 | 1.30 | 165.67 | 1.3 | 5.00 | | | |
| CP-C50 | 1.30 | 165.38 | 1.3 | 5.00 | | | |
| CP-C51 | 1.30 | 158.08 | 1.3 | 5.00 | | | |
| CP-C52 | 1.30 | 137.00 | 1.3 | 5.00 | | | |
| CP-C53 | 1.30 | 312.92 | 1.3 | 5.00 | | | |
| CP-C54 | 1.30 | 83.75 | 1.3 | 5.00 | | | |

Preparation Examples of Conductive Layer-Forming Coating Solutions CP-58 to CP-62

The type (including coating ratio, doping ratio, and density, the same applies hereafter) and amount of the first metal oxide particles, the type (including doping ratio and density, the same applies hereafter) and amount of the second metal oxide particles, and the amount of the binder material were changed to those listed in Table 6. Except for the above changes, conductive layer-forming coating solutions CP-58 to CP-62 were prepared in the same manner as in Preparation Example of the conductive layer-forming coating solution CP-1. The powder resistivity of Ta-doped tin oxide-coated zinc oxide particles serving as the first metal oxide particles used for the preparation of the conductive layer-forming coating solutions CP-58 to CP-62 was 4500 Ω·cm. The powder resistivity of Ta-doped tin oxide particles (doping ratio: 4.50 mass %, density: 7.39 g/cm$^3$) used as the second metal oxide particles was 160 Ω·cm.

Preparation Examples of Conductive Layer-Forming Coating Solutions CP-C55 to CP-C60

The type and amount of the first metal oxide particles, the type and amount of the second metal oxide particles, and the amount of the binder material were changed to those listed in Table 6. Except for the above changes, conductive layer-forming coating solutions CP-C55 to CP-C60 were prepared in the same manner as in Preparation Example of the conductive layer-forming coating solution CP-1. The powder resistivity of Ta-doped tin oxide-coated zinc oxide particles serving as the first metal oxide particles used for the preparation of the conductive layer-forming coating solutions was 4500 Ω·cm. The powder resistivity of Ta-doped tin oxide particles (doping ratio: 4.50 mass %, density: 7.39 g/cm$^3$) used as the second metal oxide particles was 160 Ω·cm.

Preparation Examples of Conductive Layer-Forming Coating Solutions CP-63 to CP-67

The type (including coating ratio, doping ratio, and density, the same applies hereafter) and amount of the first metal oxide particles, the type (including doping ratio and density, the same applies hereafter) and amount of the second metal oxide particles, and the amount of the binder material were changed to those listed in Table 6. Except for the above changes, conductive layer-forming coating solutions CP-63 to CP-67 were prepared in the same manner as in Preparation Example of the conductive layer-forming coating solution CP-1. The powder resistivity of Ta-doped tin oxide-coated tin oxide particles serving as the first metal oxide particles used for the preparation of the conductive layer-forming coating solutions CP-63 to CP-67 was 4500 Ω·cm. The powder resistivity of Ta-doped tin oxide particles (doping ratio: 4.50 mass %, density: 7.39 g/cm$^3$) used as the second metal oxide particles was 160 Ω·cm.

Preparation Examples of Conductive Layer-Forming Coating Solutions CP-C61 to CP-C66

The type and amount of the first metal oxide particles, the type and amount of the second metal oxide particles, and the amount of the binder material were changed to those listed in Table 6. Except for the above changes, conductive layer-forming coating solutions CP-C61 to CP-C66 were prepared in the same manner as in Preparation Example of the conductive layer-forming coating solution CP-1. The powder resistivity of Ta-doped tin oxide-coated tin oxide particles serving as the first metal oxide particles used for the preparation of the conductive layer-forming coating solutions was 4500 Ω·cm. The powder resistivity of Ta-doped tin oxide particles (doping ratio: 4.50 mass %, density: 7.39 g/cm$^3$) used as the second metal oxide particles was 160 Ω·cm.

TABLE 6

| Conductive layer-forming coating solution | (1) First metal oxide particles | | | | | (2) Second metal oxide particles | | | |
|---|---|---|---|---|---|---|---|---|---|
| | Type | Coating ratio % | Doping ratio % | Density g/cm$^3$ | Part by mass | Type | Doping ratio % | Density g/cm$^3$ | Part by mass |
| CP-58 | Ta-doped tin oxide-coated zinc oxide particles (volume-average particle size: 230 nm) | 45 | 4.50 | 6.29 | 123.21 | Ta-doped tin oxide particles (volume-average particle size: 20 nm) | 4.50 | 7.39 | 18.82 |
| CP-59 | | 45 | 4.50 | 6.29 | 211.52 | | 4.50 | 7.39 | 4.96 |
| CP-60 | | 45 | 4.50 | 6.29 | 187.41 | | 4.50 | 7.39 | 28.62 |
| CP-61 | | 45 | 4.50 | 6.29 | 166.69 | | 4.50 | 7.39 | 48.97 |
| CP-62 | | 45 | 4.50 | 6.29 | 226.81 | | 4.50 | 7.39 | 34.63 |
| CP-C55 | | 45 | 4.50 | 6.29 | 216.57 | No | | | |
| CP-C56 | | 45 | 4.50 | 6.29 | 213.98 | Ta-doped tin oxide particles (volume-average particle size: 20 nm) | 4.50 | 7.39 | 2.50 |
| CP-C57 | | 45 | 4.50 | 6.29 | 159.35 | | 4.50 | 7.39 | 56.20 |
| CP-C58 | | No | | | | | 4.50 | 7.39 | 212.66 |
| CP-C59 | Ta-doped tin oxide-coated zinc oxide particles (volume-average particle size: 230 nm) | 45 | 4.50 | 6.29 | 91.88 | | 4.50 | 7.39 | 14.06 |
| CP-C60 | | 45 | 4.50 | 6.29 | 236.74 | | 4.50 | 7.39 | 36.18 |
| CP-63 | Ta-doped tin oxide-coated tin oxide particles (volume-average particle size: 230 nm) | 45 | 4.50 | 7.14 | 139.86 | Ta-doped tin oxide particles (volume-average particle size: 20 nm) | 4.50 | 7.39 | 18.82 |
| CP-64 | | 45 | 4.50 | 7.14 | 240.10 | | 4.50 | 7.39 | 4.96 |
| CP-65 | | 45 | 4.50 | 7.14 | 212.73 | | 4.50 | 7.39 | 28.62 |
| CP-66 | | 45 | 4.50 | 7.14 | 189.21 | | 4.50 | 7.39 | 48.97 |
| CP-67 | | 45 | 4.50 | 7.14 | 257.46 | | 4.50 | 7.39 | 34.63 |
| CP-C61 | | 45 | 4.50 | 7.14 | 245.84 | No | | | |
| CP-C62 | | 45 | 4.50 | 7.14 | 242.90 | Ta-doped tin oxide particles (volume-average particle size: 20 nm) | 4.50 | 7.39 | 2.50 |
| CP-C63 | | 45 | 4.50 | 7.14 | 180.88 | | 4.50 | 7.39 | 56.20 |
| CP-C64 | | No | | | | | 4.50 | 7.39 | 212.66 |
| CP-C65 | | 45 | 4.50 | 7.14 | 104.3 | | 4.50 | 7.39 | 14.06 |
| CP-C66 | | 45 | 4.50 | 7.14 | 268.73 | | 4.50 | 7.39 | 36.18 |

TABLE 6-continued

| Conductive layer-forming coating solution | (3) Binder material: Density g/cm³ | (3) Binder material: Part by mass (resin solid content is 60 mass % of the following value) | (4) Silicone resin particles: Density g/cm³ | (4) Silicone resin particles: Part by mass | (5) Particles other than (1) to (4): Type | (5) Particles other than (1) to (4): Density g/cm³ | (5) Particles other than (1) to (4): Part by mass |
|---|---|---|---|---|---|---|---|
| CP-58 | 1.30 | 263.40 | 1.3 | 5.00 | | No | |
| CP-59 | 1.30 | 165.00 | 1.3 | 5.00 | | | |
| CP-60 | 1.30 | 161.83 | 1.3 | 5.00 | | | |
| CP-61 | 1.30 | 159.08 | 1.3 | 5.00 | | | |
| CP-62 | 1.30 | 99.50 | 1.3 | 5.00 | | | |
| CP-C55 | 1.30 | 165.67 | 1.3 | 5.00 | | | |
| CP-C56 | 1.30 | 165.38 | 1.3 | 5.00 | | | |
| CP-C57 | 1.30 | 158.08 | 1.3 | 5.00 | | | |
| CP-C58 | 1.30 | 137.00 | 1.3 | 5.00 | | | |
| CP-C59 | 1.30 | 312.92 | 1.3 | 5.00 | | | |
| CP-C60 | 1.30 | 83.75 | 1.3 | 5.00 | | | |
| CP-63 | 1.30 | 263.40 | 1.3 | 5.00 | | No | |
| CP-64 | 1.30 | 165.00 | 1.3 | 5.00 | | | |
| CP-65 | 1.30 | 161.83 | 1.3 | 5.00 | | | |
| CP-66 | 1.30 | 159.08 | 1.3 | 5.00 | | | |
| CP-67 | 1.30 | 99.50 | 1.3 | 5.00 | | | |
| CP-C61 | 1.30 | 165.67 | 1.3 | 5.00 | | | |
| CP-C62 | 1.30 | 165.38 | 1.3 | 5.00 | | | |
| CP-C63 | 1.30 | 158.08 | 1.3 | 5.00 | | | |
| CP-C64 | 1.30 | 137.00 | 1.3 | 5.00 | | | |
| CP-C65 | 1.30 | 312.92 | 1.3 | 5.00 | | | |
| CP-C66 | 1.30 | 83.75 | 1.3 | 5.00 | | | |

Preparation Example of Conductive Layer-Forming Coating Solution CP-C67

A conductive layer-forming coating solution CP-C67 was prepared through the following process with reference to Example 1 described in Japanese Unexamined Patent Application Publication No. 2004-151349.

Specifically, 20 parts of barium sulfate particles coated with oxygen-deficient tin oxide (coating ratio: 50 mass %, volume-average particle size: 600 nm, density: 5.1 g/cm$^3$), 100 parts of antimony-doped tin oxide particles (trade name: T-1 manufactured by Mitsubishi Materials Corporation, volume-average particle size: 20 nm, powder resistivity: 5 Ω·cm, density: 6.6 g/cm$^3$), 70 parts of a resol-type phenolic resin (trade name: Plyophen J-325) serving as a binder material, and 100 parts of 2-methoxy-1-propanol were inserted into a ball mill. A dispersion treatment was performed for 20 hours to prepare a conductive layer-forming coating solution CP-C67.

Preparation Example of Conductive Layer-Forming Coating Solution CP-C68

A conductive layer-forming coating solution CP-C68 was prepared in the same manner as in Preparation Example of the conductive layer-forming coating solution CP-C67, except that the antimony-doped tin oxide particles were changed to tantalum-doped tin oxide particles (volume-average particle size: 20 nm, density: 6.1 g/cm$^3$).

Preparation Example of Conductive Layer-Forming Coating Solution CP-C69

Into a sand mill, 167.42 parts of uncoated zinc oxide particles (powder resistivity: $2.0\times10^8$ Ω·cm, volume-average particle size: 210 nm, density: 5.61 g/cm$^3$), 25.6 parts of oxygen-deficient tin oxide particles (powder resistivity: 200 Ω·cm, volume-average particle size: 20 nm, density: 6.60 g/cm$^3$), 162.00 parts of a phenolic resin (trade name: Plyophen J-325) serving as a binder material, and 120 parts of 1-methoxy-2-propanol were inserted together with 465 parts of glass beads having a diameter of 0.8 mm. A dispersion treatment was performed under dispersion treatment conditions of disc rotational speed: 2000 rpm, dispersion treatment time: 4.5 hours, and temperature of cooling water: 18° C. to obtain a dispersion liquid.

After the glass beads were removed from the dispersion liquid with a mesh, 5.00 parts of silicone resin particles (trade name: Tospearl 120) were added to the dispersion liquid. Furthermore, 0.30 parts of silicone oil (trade name: SH28PA) was added to the dispersion liquid, and stirring was performed for 30 minutes to prepare a conductive layer-forming coating solution CP-C69.

Preparation Example of Conductive Layer-Forming Coating Solution CP-C70

Into a sand mill, 244.40 parts of tin-zinc composite oxide particles (powder resistivity: $2.0\times10^9$ Ω·cm, volume-average particle size: 100 nm, density: 6.10 g/cm$^3$) described in Example 1 of Japanese Unexamined Patent Application Publication No. 2013-37289, 162.00 parts of a phenolic resin (trade name: Plyophen J-325), and 120 parts of 1-methoxy-2-propanol were inserted together with 465 parts of glass beads having a diameter of 0.8 mm. A dispersion treatment was performed under dispersion treatment conditions of disc rotational speed: 2000 rpm, dispersion treatment time: 4.5 hours, and temperature of cooling water: 18° C. to obtain a dispersion liquid.

After the glass beads were removed from the dispersion liquid with a mesh, 5.00 parts of silicone resin particles (trade name: Tospearl 120) were added to the dispersion liquid. Furthermore, 0.30 parts of silicone oil (trade name: SH28PA) was added to the dispersion liquid, and stirring was performed for 30 minutes to prepare a conductive layer-forming coating solution CP-C70.

TABLE 7

| Conductive layer-forming coating solution | (1) First metal oxide particles | | | | | (2) Second metal oxide particles | | | |
|---|---|---|---|---|---|---|---|---|---|
| | Type | Coating ratio % | Doping ratio % | Density g/cm$^3$ | Part by mass | Type | Doping ratio % | Density g/cm$^3$ | Part by mass |
| CP-C67 | Oxygen-deficient $SnO_2$-coated $BaSO_4$ | 50 | — | 5.1 | 20.00 | Sb-doped $SnO_2$ | | 6.6 | 100.00 |
| CP-C68 | Oxygen-deficient $SnO_2$-coated $BaSO_4$ | 50 | — | 5.1 | 20.00 | Ta-doped $SnO_2$ | | 6.1 | 20.00 |
| CP-C69 | Uncoated zinc oxide particles (average particle size: 210 nm) | — | — | 5.6 | 167.42 | Oxygen-deficient $SnO_2$ (average particle size: 20 nm) | — | 6.6 | 25.60 |
| CP-C70 | Uncoated zinc oxide particles (average particle size: 210 nm) | — | — | 6.1 | 244.40 | | No | | |

| Conductive layer-forming coating solution | (3) Binder material | | (4) Silicone resin particles | | (5) Particles other than (1) to (4) | | |
|---|---|---|---|---|---|---|---|
| | Density g/cm$^3$ | Part by mass (resin solid content is 60 mass % of the following value) | Density g/cm$^3$ | Part by mass | Type | Density g/cm$^3$ | Part by mass |
| CP-C67 | 1.3 | 70 (solid content: 70%) | — | 0.00 | No | | |
| CP-C68 | 1.3 | 70 (solid content: 70%) | — | 0.00 | | | |
| CP-C69 | 1.3 | 162 (solid content: 60%) | 1.3 | 5.00 | | | |
| CP-C70 | 1.3 | 162 (solid content: 70%) | 1.3 | 5.00 | | | |

Example 1

Production Example of Electrophotographic Photosensitive Member

An aluminum cylinder (JIS A 3003, aluminum alloy) with a length of 251.5 mm, a diameter of 24 mm, and a thickness of 1.0 mm, which was produced by a method including extrusion and drawing, was used as a support (cylindrical support)

The conductive layer-forming coating solution CP-1 was applied onto the support by dipping at 22° C. and 55% RH to form a coating film. The resulting coating film was dried and heat-cured at 140° C. for 30 minutes to form a conductive layer having a thickness of 20 μm. The volume resistivity of the formed conductive layer was $1.3\times10^{13}$ Ω·cm.

Subsequently, an undercoat layer-forming coating solution was prepared by dissolving 4.5 parts of N-methoxymethylated nylon (trade name: Toresin EF-30T manufactured by Teikoku Chemical Industries Co., Ltd.) and 1.5 parts of copolymer nylon resin (trade name: Amilan CM8000 manufactured by Toray Industries, Inc.) in a mixed solvent of methanol 65 parts/n-butanol 30 parts. The undercoat layer-forming coating solution was applied onto the conductive layer by dipping. The resulting coating film was dried at 70° C. for 6 minutes to form an undercoat layer having a thickness of 0.85 μm.

Subsequently, a hydroxygallium phthalocyanine crystal (charge generation material) having peaks at Bragg angles (2θ±0.2°) of 7.5°, 9.9°, 16.3°, 18.6°, 25.1°, and 28.3° in CuKα characteristic X-ray diffraction was prepared. Into a sand mill, 10 parts of the hydroxygallium phthalocyanine crystal, 5 parts of polyvinyl butyral (trade name: S-LEC BX-1 manufactured by SEKISUI CHEMICAL CO., LTD.), and 250 parts of cyclohexanone were inserted together with glass beads having a diameter of 1 mm. A dispersion treatment was performed for a dispersion treatment time of 3 hours. After the dispersion treatment, the glass beads were removed and 250 parts of ethyl acetate was added to prepare a charge generating layer-forming coating solution. The charge generating layer-forming coating solution was applied onto the undercoat layer by dipping. The resulting coating film was dried at 100° C. for 10 minutes to form a charge generating layer having a thickness of 0.12 μm.

Subsequently, 56 parts of an amine compound (charge transport material) represented by formula (CT-1) below, (CT-1)

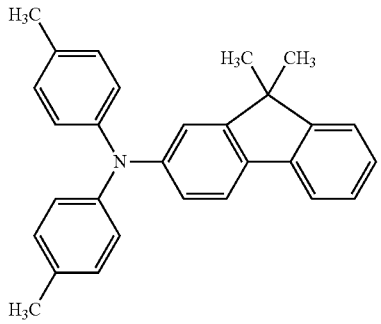

24 parts of an amine compound (charge transport material) represented by formula (CT-2) below, (CT-2)

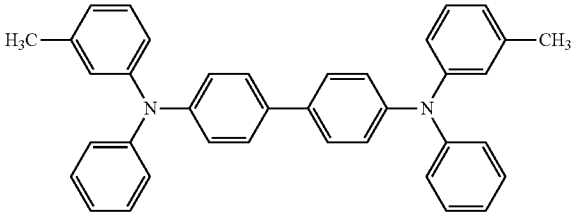

90 parts of polycarbonate (trade name: 2200 manufactured by Mitsubishi Engineering-Plastics Corporation), 10 parts of siloxane-modified polycarbonate having a structural unit represented by formula (B-1) below and a structural unit represented by formula (B-2) below ((B-1):(B-2)=98:2 (molar ratio)), and (B-1)

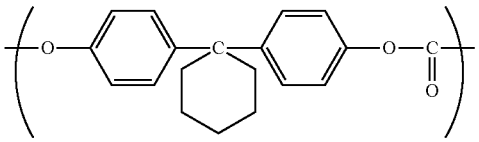

(B-2)

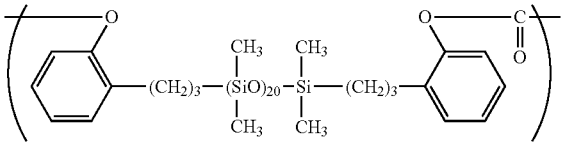

0.9 parts of siloxane-modified polycarbonate having a structural unit represented by formula (B-3) below, a structural unit represented by formula (B-4) below, and a terminal structure represented by formula (B-5) below ((B-3):(B-4)=95:5 (molar ratio))

(B-3)

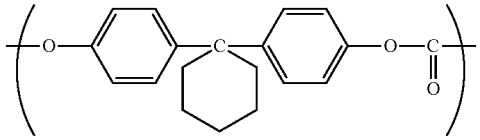

(B-4)

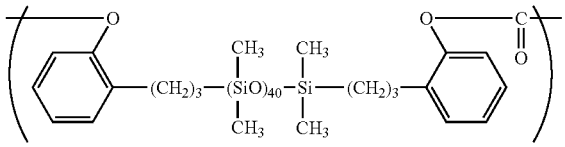

(B-5)

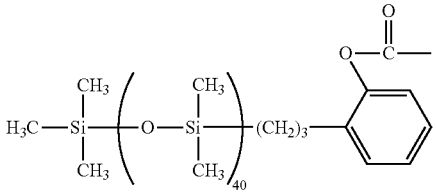

were dissolved in a mixed solvent containing 300 parts of o-xylene, 250 parts of dimethoxymethane, and 27 parts of methyl benzoate to prepare a charge transporting layer-forming coating solution. The charge transporting layer-forming coating solution was applied onto the charge generating layer by dipping. The resulting coating film was dried at 120° C. for 30 minutes to form a charge transporting layer having a thickness of 18.5 μm. The mass ratio of the terminal structure represented by the formula (B-5) was 15 mass % based on the siloxane-modified polycarbonate. Thus, an electrophotographic photosensitive member 1 whose charge transporting layer served as a surface layer was produced.

For the electrophotographic photosensitive member 1, the ratio of phosphorus to tin oxide in the P-doped tin oxide-coated zinc oxide particles and the ratio of phosphorus to tin oxide in the P-doped tin oxide particles were each determined from the atomic ratio by the above-described method.

Subsequently, the P-doped tin oxide-coated zinc oxide particles and the P-doped tin oxide particles were identified from the difference in the contrast of Slice & View of FIB-SEM by the above-described method. The volume-average particle size of the P-doped tin oxide-coated zinc oxide particles and the volume-average particle size of the P-doped tin oxide particles were then measured. The same applies in the following examples. In Example 1, the volume-average particle size of the P-doped tin oxide-coated zinc oxide particles in the conductive layer was 230 nm and the volume-average particle size of the P-doped tin oxide particles was 20 nm.

Examples 2 to 67 and Comparative Examples 1 to 70

Production Examples of Electrophotographic Photosensitive Members 2 to 67 and C1 to C70

Electrophotographic photosensitive members 2 to 67 and C1 to C70 were produced in the same manner as in Example (Production Example of the electrophotographic photosensitive member 1), except that the conductive layer-forming coating solution was changed to those listed in Tables 8 to 13.

Evaluation

The formation of cracks was evaluated by observing a surface of the conductive layer with an optical microscope when the conductive layer was formed on the support and also by observing an image output from an electrophotographic apparatus (laser beam printer) equipped with the produced electrophotographic photosensitive member.

Figure 5:
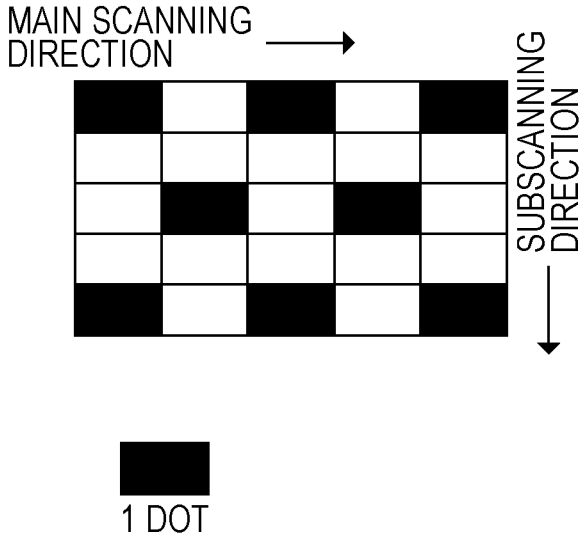
FIG. 5 is a diagram for describing a similar knight jump pattern image.

The image was observed as follows. The produced electrophotographic photosensitive member was set in a laser beam printer (trade name: LaserJet P2055dn) manufactured by Hewlett-Packard Company, which was used as an evaluation apparatus. The laser beam printer was placed in an ordinary-temperature and ordinary-humidity environment (23° C./50% RH). A solid black image, a blank image, and a halftone image with a similar knight jump pattern were output, and the output images were observed. The halftone image with a similar knight jump pattern is a halftone image with a pattern illustrated in FIG. 5.

The degree of the formation of cracks was ranked as follows on the basis of the image observation described above and the observation of the conductive layer with an optical microscope described below.

Rank 3: The formation of cracks was not confirmed when the surface of the conductive layer was observed with an optical microscope.

Rank 2: The formation of cracks was confirmed when the surface of the conductive layer was observed with an optical microscope, but image defects caused by the formation of cracks were not confirmed on any of the solid black image, the blank image, and the halftone image with a similar knight jump pattern.

Rank 1: The formation of cracks was confirmed when the surface of the conductive layer was observed with an optical microscope, and image defects that seemed to be caused by the formation of cracks were confirmed on any of the solid black image, the blank image, and the halftone image with a similar knight jump pattern.

The residual potential and the pattern memory were evaluated by using, as an evaluation apparatus, a laser beam printer (trade name: LaserJet P2055dn) manufactured by Hewlett-Packard Company.

The pattern memory was evaluated as follows. The produced electrophotographic photosensitive member was set in the laser beam printer manufactured by Hewlett-Packard Company. The laser beam printer was placed in a low-temperature and low-humidity (15° C./7% RH) environment, and an image having a vertical line pattern of 3 dots and 100 spaces was continuously output on 15000 sheets. Subsequently, four types of halftone images and a solid black image shown in Table 14 were output. The degree of the formation of the pattern memory was classified into six ranks shown in Table 14 in accordance with the visibility of vertical streaks due to the hysteresis of the vertical lines on the output images. The four types of halftone images are a halftone image with a similar knight jump pattern, a halftone image with a 1-dot-and-1-space horizontal line pattern, a halftone image with a 2-dot-and-3-space horizontal line pattern, and a halftone image with a 1-dot-and-2-space horizontal line pattern.

The residual potential was evaluated as follows. Before and after the 15000 sheets were continuously output, the residual potential was measured after 3 blank images and 5 solid black images were continuously output. The evaluation of the residual potential was ranked as follows in accordance with an increase in the residual potential before and after the 15000 sheets were continuously output.

Rank 4: The increase in residual potential was 10 V or less.

Rank 3: The increase in residual potential was more than 10 V and 20 V or less.

Rank 2: The increase in residual potential was more than 20 V and 30 V or less.

Rank 1: The increase in residual potential was more than 30 V.

Tables 8 to 13 show the results.

TABLE 8

| Example / Comparative Example | Conductive layer-forming coating solution | Production Example of electro-photographic photosensitive member | {(V2/VT)/(V1/VT)} × 100 | {(V1/VT) + (V2/VT)} × 100 | R2/R1 | Volume resistivity of conductive layer Ω · cm | Evaluation result: Pattern memory | Residual potential | Crack |
|---|---|---|---|---|---|---|---|---|---|
| Example 1 | CP-1 | 1 | 2 | 15 | 1.0 | 1.3E+13 | 5 | 3 | 3 |
| Example 2 | CP-2 | 2 | 5 | 15 | 1.0 | 1.3E+13 | 6 | 3 | 3 |
| Example 3 | CP-3 | 3 | 13 | 15 | 1.0 | 1.2E+13 | 6 | 3 | 3 |
| Example 4 | CP-4 | 4 | 25 | 15 | 1.0 | 1.2E+13 | 4 | 3 | 3 |
| Example 5 | CP-5 | 5 | 13 | 20 | 0.8 | 2.9E+12 | 5 | 4 | 3 |
| Example 6 | CP-6 | 6 | 13 | 20 | 0.9 | 3.0E+12 | 6 | 4 | 3 |
| Example 7 | CP-7 | 7 | 13 | 20 | 1.0 | 3.0E+12 | 6 | 4 | 3 |
| Example 8 | CP-8 | 8 | 13 | 20 | 1.1 | 3.0E+12 | 6 | 4 | 3 |
| Example 9 | CP-9 | 9 | 13 | 20 | 1.2 | 3.0E+12 | 5 | 4 | 3 |
| Example 10 | CP-10 | 10 | 20 | 20 | 1.0 | 2.9E+12 | 6 | 4 | 3 |
| Example 11 | CP-11 | 11 | 2 | 30 | 1.0 | 1.0E+11 | 5 | 4 | 3 |
| Example 12 | CP-12 | 12 | 5 | 30 | 1.0 | 9.9E+10 | 6 | 4 | 3 |
| Example 13 | CP-13 | 13 | 13 | 30 | 1.0 | 9.4E+10 | 6 | 4 | 3 |
| Example 14 | CP-14 | 14 | 20 | 30 | 1.0 | 8.9E+10 | 6 | 4 | 3 |
| Example 15 | CP-15 | 15 | 25 | 30 | 1.0 | 8.7E+10 | 4 | 4 | 3 |
| Example 16 | CP-16 | 16 | 5 | 40 | 1.0 | 1.0E+09 | 6 | 4 | 3 |
| Example 17 | CP-17 | 17 | 2 | 45 | 1.0 | 5.8E+07 | 5 | 4 | 2 |
| Example 18 | CP-18 | 18 | 13 | 45 | 1.0 | 4.9E+07 | 6 | 4 | 2 |
| Example 19 | CP-19 | 19 | 25 | 45 | 1.0 | 4.2E+07 | 4 | 4 | 2 |
| Example 20 | CP-20 | 20 | 13 | 30 | 1.0 | 3.9E+10 | 6 | 4 | 3 |
| Example 21 | CP-21 | 21 | 13 | 30 | 1.0 | 4.2E+10 | 6 | 4 | 3 |
| Example 22 | CP-22 | 22 | 11 | 30 | 1.0 | 4.0E+10 | 6 | 4 | 3 |
| Example 23 | CP-23 | 23 | 13 | 15 | 1.0 | 8.4E+12 | 6 | 3 | 3 |
| Example 24 | CP-24 | 24 | 2 | 30 | 1.0 | 3.6E+10 | 5 | 4 | 3 |

TABLE 8-continued

| Example Comparative Example | Conductive layer-forming coating solution | Production Example of electro-photographic photosensitive member | {(V2/VT)/(V1/VT)} × 100 | {(V1/VT) + (V2/VT)} × 100 | R2/R1 | Volume resistivity of conductive layer Ω · cm | Evaluation result Pattern memory | Residual potential | Crack |
|---|---|---|---|---|---|---|---|---|---|
| Example 25 | CP-25 | 25 | 13 | 30 | 1.0 | 3.7E+10 | 6 | 4 | 3 |
| Example 26 | CP-26 | 26 | 25 | 30 | 1.0 | 3.7E+10 | 4 | 4 | 3 |
| Example 27 | CP-27 | 27 | 13 | 45 | 1.0 | 8.1E+06 | 6 | 4 | 2 |
| Comparative Example 1 | CP-C2 | C2 | — | — | — | 1.0E+11 | 1 | 4 | 3 |
| Comparative Example 2 | CP-C5 | C5 | 1 | 30 | 1.0 | 1.0E+11 | 2 | 4 | 3 |
| Comparative Example 3 | CP-C8 | C8 | 30 | 30 | 1.0 | 8.4E+10 | 2 | 4 | 3 |
| Comparative Example 4 | CP-C11 | C11 | — | — | — | 4.2E+10 | 1 | 4 | 3 |
| Comparative Example 5 | CP-C15 | C15 | 13 | 10 | 1.0 | 4.4E+13 | 6 | 1 | 3 |
| Comparative Example 6 | CP-C20 | C20 | 13 | 50 | 1.0 | 1.4E+06 | 6 | 4 | 1 |
| Comparative Example 7 | CP-C23 | C23 | — | — | — | 8.4E+10 | 1 | 4 | 3 |
| Comparative Example 8 | CP-C25 | C25 | — | — | — | 8.8E+10 | 1 | 4 | 3 |
| Comparative Example 9 | CP-C27 | C27 | — | — | — | 8.8E+10 | 1 | 4 | 3 |
| Comparative Example 10 | CP-C28 | C28 | — | — | — | 9.5E+10 | 1 | 4 | 3 |
| Comparative Example 11 | CP-C29 | C29 | — | — | — | 6.7E+10 | 1 | 4 | 3 |
| Comparative Example 12 | CP-C32 | C32 | — | — | — | 9.4E+10 | 1 | 4 | 3 |
| Comparative Example 13 | CP-C35 | C35 | — | — | — | 3.6E+10 | 1 | 4 | 3 |
| Comparative Example 14 | CP-C38 | C38 | 1 | 30 | 1.0 | 3.6E+10 | 2 | 4 | 3 |
| Comparative Example 15 | CP-C41 | C41 | 30 | 30 | 1.0 | 3.7E+10 | 2 | 4 | 3 |
| Comparative Example 16 | CP-C48 | C48 | 13 | 10 | 1.0 | 3.4E+13 | 6 | 1 | 3 |
| Comparative Example 17 | CP-C53 | C53 | 13 | 50 | 1.0 | 1.6E+05 | 6 | 4 | 1 |
| Comparative Example 18 | CP-C44 | C44 | — | — | — | 4.2E+10 | 1 | 4 | 3 |

TABLE 9

| Example Comparative Example | Conductive layer-forming coating solution | Production Example of electro-photographic photosensitive member | {(V2/VT)/(V1/VT)} × 100 | {(V1/VT) + (V2/VT)} × 100 | R2/R1 | Volume resistivity of conductive layer Ω · cm | Evaluation result Pattern memory | Residual potential | Crack |
|---|---|---|---|---|---|---|---|---|---|
| Example 28 | CP-28 | 28 | 13 | 15 | 1.0 | 1.0E+13 | 6 | 3 | 3 |
| Example 29 | CP-29 | 29 | 2 | 30 | 1.0 | 7.0E+10 | 5 | 4 | 3 |
| Example 30 | CP-30 | 30 | 13 | 30 | 1.0 | 6.0E+10 | 6 | 4 | 3 |
| Example 31 | CP-31 | 31 | 25 | 30 | 1.0 | 5.2E+10 | 4 | 4 | 3 |
| Example 32 | CP-32 | 32 | 13 | 45 | 1.0 | 2.1E+07 | 6 | 4 | 2 |
| Comparative Example 19 | CP-C19 | C19 | — | — | — | 7.2E+10 | 1 | 4 | 3 |
| Comparative Example 20 | CP-C20 | C20 | 1 | 30 | 1.0 | 7.1E+10 | 2 | 4 | 3 |
| Comparative Example 21 | CP-C21 | C21 | 30 | 30 | 1.0 | 5.0E+10 | 2 | 4 | 3 |
| Comparative Example 22 | CP-C22 | C22 | — | — | — | 1.4E+10 | 1 | 4 | 3 |
| Comparative Example 23 | CP-C23 | C23 | 13 | 10 | 1.0 | 3.9E+13 | 6 | 1 | 3 |
| Comparative Example 24 | CP-C24 | C24 | 13 | 50 | 1.0 | 5.0E+05 | 6 | 4 | 1 |
| Example 33 | CP-33 | 33 | 13 | 15 | 1.0 | 6.8E+12 | 6 | 3 | 3 |

TABLE 9-continued

| Example Comparative Example | Conductive layer-forming coating solution | Production Example of electro-photographic photosensitive member | {(V2/VT)/(V1/VT)} × 100 | {(V1/VT) + (V2/VT)} × 100 | R2/R1 | Volume resistivity of conductive layer Ω · cm | Evaluation result Pattern memory | Residual potential | Crack |
|---|---|---|---|---|---|---|---|---|---|
| Example 34 | CP-34 | 34 | 2 | 30 | 1.0 | 2.2E+10 | 5 | 4 | 3 |
| Example 35 | CP-35 | 35 | 13 | 30 | 1.0 | 2.1E+10 | 6 | 4 | 3 |
| Example 36 | CP-36 | 36 | 25 | 30 | 1.0 | 2.1E+10 | 4 | 4 | 3 |
| Example 37 | CP-37 | 37 | 13 | 45 | 1.0 | 2.9E+06 | 6 | 4 | 2 |
| Comparative Example 25 | CP-C25 | C25 | — | — | — | 2.2E+10 | 1 | 4 | 3 |
| Comparative Example 26 | CP-C26 | C26 | 1 | 30 | 1.0 | 2.2E+10 | 2 | 4 | 3 |
| Comparative Example 27 | CP-C27 | C27 | 30 | 30 | 1.0 | 2.0E+10 | 2 | 4 | 3 |
| Comparative Example 28 | CP-C28 | C28 | — | — | — | 1.4E+10 | 1 | 4 | 3 |
| Comparative Example 29 | CP-C29 | C29 | 13 | 10 | 1.0 | 3.0E+13 | 6 | 1 | 3 |
| Comparative Example 30 | CP-C30 | C30 | 13 | 50 | 1.0 | 4.5E+04 | 6 | 4 | 1 |

TABLE 10

| Example Comparative Example | Conductive layer-forming coating solution | Production Example of electro-photographic photosensitive member | {(V2/VT)/(V1/VT)} × 100 | {(V1/VT) + (V2/VT)} × 100 | R2/R1 | Volume resistivity of conductive layer Ω · cm | Evaluation result Pattern memory | Residual potential | Crack |
|---|---|---|---|---|---|---|---|---|---|
| Example 38 | CP-38 | 38 | 13 | 15 | 1.0 | 1.3E+13 | 6 | 3 | 3 |
| Example 39 | CP-39 | 39 | 2 | 30 | 1.0 | 1.1E+11 | 5 | 4 | 3 |
| Example 40 | CP-40 | 40 | 13 | 30 | 1.0 | 9.8E+10 | 6 | 4 | 3 |
| Example 41 | CP-41 | 41 | 25 | 30 | 1.0 | 9.1E+10 | 4 | 4 | 3 |
| Example 42 | CP-42 | 42 | 13 | 45 | 1.0 | 5.4E+07 | 6 | 4 | 2 |
| Comparative Example 31 | CP-C31 | C31 | — | — | — | 1.1E+11 | 1 | 4 | 3 |
| Comparative Example 32 | CP-C32 | C32 | 1 | 30 | 1.0 | 1.1E+11 | 2 | 4 | 3 |
| Comparative Example 33 | CP-C33 | C33 | 30 | 30 | 1.0 | 8.9E+10 | 2 | 4 | 3 |
| Comparative Example 34 | CP-C34 | C34 | — | — | — | 4.7E+10 | 1 | 4 | 3 |
| Comparative Example 35 | CP-C35 | C35 | 13 | 10 | 1.0 | 4.4E+13 | 6 | 1 | 3 |
| Comparative Example 36 | CP-C36 | C36 | 13 | 50 | 1.0 | 1.6E+06 | 6 | 4 | 1 |
| Example 43 | CP-43 | 43 | 13 | 15 | 1.0 | 8.6E+12 | 6 | 3 | 3 |
| Example 44 | CP-44 | 44 | 2 | 30 | 1.0 | 3.8E+10 | 5 | 4 | 3 |
| Example 45 | CP-45 | 45 | 13 | 30 | 1.0 | 3.9E+10 | 6 | 4 | 3 |
| Example 46 | CP-46 | 46 | 25 | 30 | 1.0 | 3.9E+10 | 4 | 4 | 3 |
| Example 47 | CP-47 | 47 | 13 | 45 | 1.0 | 9.0E+06 | 6 | 4 | 2 |
| Comparative Example 37 | CP-C37 | C37 | — | — | — | 3.8E+10 | 1 | 4 | 3 |
| Comparative Example 38 | CP-C38 | C38 | 1 | 30 | 1.0 | 3.8E+10 | 2 | 4 | 3 |
| Comparative Example 39 | CP-C39 | C39 | 30 | 30 | 1.0 | 3.9E+10 | 2 | 4 | 3 |
| Comparative Example 40 | CP-C40 | C40 | — | — | — | 4.7E+10 | 1 | 4 | 3 |
| Comparative Example 41 | CP-C41 | C41 | 13 | 10 | 1.0 | 3.5E+13 | 6 | 1 | 3 |
| Comparative Example 42 | CP-C42 | C42 | 13 | 50 | 1.0 | 1.8E+05 | 6 | 4 | 1 |

TABLE 11

| Example / Comparative Example | Conductive layer-forming coating solution | Production Example of electro-photographic photosensitive member | {(V2/VT)/(V1/VT)} × 100 | {(V1/VT) + (V2/VT)} × 100 | R2/R1 | Volume resistivity of conductive layer Ω · cm | Evaluation result: Pattern memory | Residual potential | Crack |
|---|---|---|---|---|---|---|---|---|---|
| Example 48 | CP-48 | 48 | 13 | 15 | 1.0 | 1.2E+13 | 6 | 3 | 3 |
| Example 49 | CP-49 | 49 | 2 | 30 | 1.0 | 8.7E+10 | 5 | 4 | 3 |
| Example 50 | CP-50 | 50 | 13 | 30 | 1.0 | 7.8E+10 | 6 | 4 | 3 |
| Example 51 | CP-51 | 51 | 25 | 30 | 1.0 | 7.1E+10 | 4 | 4 | 3 |
| Example 52 | CP-52 | 52 | 13 | 45 | 1.0 | 3.5E+07 | 6 | 4 | 2 |
| Comparative Example 43 | CP-C43 | C43 | — | — | — | 8.9E+10 | 1 | 4 | 3 |
| Comparative Example 44 | CP-C44 | C44 | 1 | 30 | 1.0 | 8.9E+10 | 2 | 4 | 3 |
| Comparative Example 45 | CP-C45 | C45 | 30 | 30 | 1.0 | 6.8E+10 | 2 | 4 | 3 |
| Comparative Example 46 | CP-C46 | C46 | — | — | — | 2.8E+10 | 1 | 4 | 3 |
| Comparative Example 47 | CP-C47 | C47 | 13 | 10 | 1.0 | 4.2E+13 | 6 | 1 | 3 |
| Comparative Example 48 | CP-C48 | C48 | 13 | 50 | 1.0 | 9.4E+05 | 6 | 4 | 1 |
| Example 53 | CP-53 | 53 | 13 | 15 | 1.0 | 7.7E+12 | 6 | 3 | 3 |
| Example 54 | CP-54 | 54 | 2 | 30 | 1.0 | 3.0E+10 | 5 | 4 | 3 |
| Example 55 | CP-55 | 55 | 13 | 30 | 1.0 | 3.0E+10 | 6 | 4 | 3 |
| Example 56 | CP-56 | 56 | 25 | 30 | 1.0 | 2.9E+10 | 4 | 4 | 3 |
| Example 57 | CP-57 | 57 | 13 | 45 | 1.0 | 5.4E+06 | 6 | 4 | 2 |
| Comparative Example 49 | CP-C49 | C49 | — | — | — | 3.0E+10 | 1 | 4 | 3 |
| Comparative Example 50 | CP-C50 | C50 | 1 | 30 | 1.0 | 3.0E+10 | 2 | 4 | 3 |
| Comparative Example 51 | CP-C51 | C51 | 30 | 30 | 1.0 | 2.9E+10 | 2 | 4 | 3 |
| Comparative Example 52 | CP-C52 | C52 | — | — | — | 2.8E+10 | 1 | 4 | 3 |
| Comparative Example 53 | CP-C53 | C53 | 13 | 10 | 1.0 | 3.3E+13 | 6 | 1 | 3 |
| Comparative Example 54 | CP-C54 | C54 | 13 | 50 | 1.0 | 9.8E+04 | 6 | 4 | 1 |

TABLE 12

| Example / Comparative Example | Conductive layer-forming coating solution | Production Example of electro-photographic photosensitive member | {(V2/VT)/(V1/VT)} × 100 | {(V1/VT) + (V2/VT)} × 100 | R2/R1 | Volume resistivity of conductive layer Ω · cm | Evaluation result: Pattern memory | Residual potential | Crack |
|---|---|---|---|---|---|---|---|---|---|
| Example 58 | CP-58 | 58 | 13 | 15 | 1.0 | 1.1E+13 | 6 | 3 | 3 |
| Example 59 | CP-59 | 59 | 2 | 30 | 1.0 | 7.4E+10 | 5 | 4 | 3 |
| Example 60 | CP-60 | 60 | 13 | 30 | 1.0 | 6.4E+10 | 6 | 4 | 3 |
| Example 61 | CP-61 | 61 | 25 | 30 | 1.0 | 5.6E+10 | 4 | 4 | 3 |
| Example 62 | CP-62 | 62 | 13 | 45 | 1.0 | 2.4E+07 | 6 | 4 | 2 |
| Comparative Example 55 | CP-C55 | C55 | — | — | — | 7.6E+10 | 1 | 4 | 3 |
| Comparative Example 56 | CP-C56 | C56 | 1 | 30 | 1.0 | 7.5E+10 | 2 | 4 | 3 |
| Comparative Example 57 | CP-C57 | C57 | 30 | 30 | 1.0 | 5.4E+10 | 2 | 4 | 3 |
| Comparative Example 58 | CP-C58 | C58 | — | — | — | 1.7E+10 | 1 | 4 | 3 |
| Comparative Example 59 | CP-C59 | C59 | 13 | 10 | 1.0 | 4.0E+13 | 6 | 1 | 3 |
| Comparative Example 60 | CP-C60 | C60 | 13 | 50 | 1.0 | 5.9E+05 | 6 | 4 | 1 |
| Example 63 | CP-63 | 63 | 13 | 15 | 1.0 | 7.0E+12 | 6 | 3 | 3 |
| Example 64 | CP-64 | 64 | 2 | 30 | 1.0 | 2.4E+10 | 5 | 4 | 3 |
| Example 65 | CP-65 | 65 | 13 | 30 | 1.0 | 2.3E+10 | 6 | 4 | 3 |
| Example 66 | CP-66 | 66 | 25 | 30 | 1.0 | 2.2E+10 | 4 | 4 | 3 |
| Example 67 | CP-67 | 67 | 13 | 45 | 1.0 | 3.4E+06 | 6 | 4 | 2 |

TABLE 12-continued

| Example Comparative Example | Conductive layer-forming coating solution | Production Example of electro-photographic photosensitive member | {(V2/VT)/(V1/VT)} × 100 | {(V1/VT) + (V2/VT)} × 100 | R2/R1 | Volume resistivity of conductive layer Ω · cm | Evaluation result Pattern memory | Residual potential | Crack |
|---|---|---|---|---|---|---|---|---|---|
| Comparative Example 61 | CP-C61 | C61 | — | — | — | 2.4E+10 | 1 | 4 | 3 |
| Comparative Example 62 | CP-C62 | C62 | 1 | 30 | 1.0 | 2.4E+10 | 2 | 4 | 3 |
| Comparative Example 63 | CP-C63 | C63 | 30 | 30 | 1.0 | 2.2E+10 | 2 | 4 | 3 |
| Comparative Example 64 | CP-C64 | C64 | — | — | — | 1.7E+10 | 1 | 4 | 3 |
| Comparative Example 65 | CP-C65 | C65 | 13 | 10 | 1.0 | 3.0E+13 | 6 | 1 | 3 |
| Comparative Example 66 | CP-C66 | C66 | 13 | 50 | 1.0 | 5.5E+04 | 6 | 4 | 1 |

TABLE 13

| Example Comparative Example | Conductive layer-forming coating solution | Production Example of electro-photographic photosensitive member | {(V2/VT)/(V1/VT)} × 100 | {(V1/VT) + (V2/VT)} × 100 | R2/R1 | Volume resistivity of conductive layer Ω · cm | Evaluation result Pattern memory | Residual potential | Crack |
|---|---|---|---|---|---|---|---|---|---|
| Comparative Example 67 | CP-C67 | C67 | — | — | — | 1.6E+10 | 1 | 4 | 3 |
| Comparative Example 68 | CP-C68 | C68 | — | — | — | 1.3E+13 | 1 | 4 | 3 |
| Comparative Example 69 | CP-C69 | C69 | — | — | — | 1.6E+11 | 1 | 2 | 3 |
| Comparative Example 70 | CP-C70 | C70 | — | — | — | 2.1E+10 | 1 | 2 | 3 |

TABLE 14

| | | Rank of pattern memory 6 | 5 | 4 | 3 | 2 | 1 |
|---|---|---|---|---|---|---|---|
| Solid black image | | invisible | visible | visible | visible | visible | visible |
| Halftone image | Similar knight jump pattern | invisible | invisible | visible | visible | visible | visible |
| | 1-dot-and-1-space horizontal line | invisible | invisible | invisible | visible | visible | visible |
| | 2-dot-and-3-space horizontal line | invisible | invisible | invisible | invisible | visible | visible |
| | 1-dot-and-2-space horizontal line | invisible | invisible | invisible | invisible | invisible | visible |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-033338, filed Feb. 24, 2014, which is hereby incorporated by reference herein in its entirety.

What is claimed is:

1. An electrophotographic photosensitive member comprising:

a support;

a conductive layer on the support; and a photosensitive layer on the conductive layer, wherein the conductive layer comprises:

a binder material;

a first metal oxide particle; and a second metal oxide particle, the first metal oxide particle is (i) a zinc oxide particle coated with tin oxide doped with one element selected from phosphorus, tungsten, niobium, tantalum, and fluorine, or (ii) a tin oxide particle coated with tin oxide doped with one element selected from phosphorus, tungsten, niobium, tantalum, and fluorine, the second metal oxide particle is a tin oxide particle doped with one element selected from phosphorus, tungsten, niobium, tantalum, and fluorine, wherein the element with which the second metal oxide particle is doped is the same as the element with which the tin oxide of the first metal oxide particle is doped, and wherein the conductive layer satisfies the following formulae (1) and (2), $$2 \leq \{(V_2/V_T)/(V_1/V_T)\} \times 100 \leq 25 \quad (1)$$

$$15 \leq \{(V_1/V_T)+(V_2/V_T)\} \times 100 \leq 45 \quad (2)$$

where in the formulae (1) and (2), $V_T$ ($cm^3$) represents a total volume of the conductive layer, $V_1$ ($cm^3$) represents a total volume of the first metal oxide particle in the conductive layer, and $V_2$ ($cm^3$) represents a total volume of the second metal oxide particle in the conductive layer.

2. The electrophotographic photosensitive member according to claim 1, wherein the conductive layer satisfies the following formula (3), $$0.9 \leq R_2/R_1 \leq 1.1 \quad (3)$$

where in the formula (3), $R_1$ (atom %) represents a ratio of phosphorus, tungsten, fluorine, niobium, or tantalum to the tin oxide that coats the first metal oxide particle, and $R_2$ (atom %) represents a ratio of phosphorus, tungsten, fluorine, niobium, or tantalum to the tin oxide in the second metal oxide particle.

3. The electrophotographic photosensitive member according to claim 1, wherein the first metal oxide particle is a zinc oxide particle coated with tin oxide doped with phosphorus or a tin oxide particle coated with tin oxide doped with phosphorus, and the second metal oxide particle is a tin oxide particle doped with phosphorus.

4. The electrophotographic photosensitive member according claim 1, wherein the first metal oxide particle is a zinc oxide particle coated with tin oxide doped with tungsten or a tin oxide particle coated with tin oxide doped with tungsten, and the second metal oxide particle is a tin oxide particle doped with tungsten.

5. The electrophotographic photosensitive member according to claim 1, wherein the first metal oxide particle is a zinc oxide particle coated with tin oxide doped with fluorine or a tin oxide particle coated with tin oxide doped with fluorine, and the second metal oxide particle is a tin oxide particle doped with fluorine.

6. The electrophotographic photosensitive member according to claim 1, wherein the first metal oxide particle is a zinc oxide particle coated with tin oxide doped with niobium or a tin oxide particle coated with tin oxide doped with niobium, and the second metal oxide particle is a tin oxide particle doped with niobium.

7. The electrophotographic photosensitive member according to claim 1, wherein the first metal oxide particle is a zinc oxide particle coated with tin oxide doped with tantalum or a tin oxide particle coated with tin oxide doped with tantalum, and the second metal oxide particle is a tin oxide particle doped with tantalum.

8. The electrophotographic photosensitive member according to claim 1, wherein the binder material is a curable resin.

9. The electrophotographic photosensitive member according to claim 1, wherein the first metal oxide particle has a volume-average particle size of 0.15 μm or more and 0.40 μm or less.

10. The electrophotographic photosensitive member according to claim 1, wherein the second metal oxide particle has a volume-average particle size of 0.01 μm or more and 0.10 μm or less.

11. A process cartridge detachably attachable to a main body of an electrophotographic apparatus, wherein the process cartridge integrally supports the electrophotographic photosensitive member according to claim 1 and at least one selected from the group consisting of a charging device, a developing device, and a cleaning member.

12. An electrophotographic apparatus comprising:

the electrophotographic photosensitive member according to claim 1;

a charging device;

an exposing device;

a developing device; and a transfer device.

* * * * *